US005321477A

United States Patent [19]

Nagata et al.

[11] Patent Number: 5,321,477

[45] Date of Patent: Jun. 14, 1994

[54] IMAGE FORMING APPARATUS CAPABLE OF PREVENTING THE WINDING ON THE IMAGE CARRIER

[75] Inventors: Tetuya Nagata, Hitachi; Takao Umeda, Mito; Takao Takuma, Hitachi; Tatsuo Igawa, Kitaibaraki; Masato Miwa, Katsuta, all of Japan

[73] Assignees: Hitachi, Ltd.; Hitachi Koki Co., Ltd., both of Tokyo, Japan

[21] Appl. No.: 952,732

[22] PCT Filed: Apr. 10, 1992

[86] PCT No.: PCT/JP92/00452

§ 371 Date: Nov. 24, 1992

§ 102(e) Date: Nov. 24, 1992

[87] PCT Pub. No.: WO92/18912

PCT Pub. Date: Oct. 29, 1992

[30] Foreign Application Priority Data

Apr. 12, 1991 [JP] Japan ..... 3-106374
Oct. 1, 1991 [JP] Japan ..... 3-278948

[51] Int. Cl.[5] ..... G03G 15/16
[52] U.S. Cl. ..... 355/273; 355/274
[58] Field of Search ..... 355/273, 274, 276, 271

[56] References Cited

U.S. PATENT DOCUMENTS 4,839,697 6/13/89 Kamitsamari et al. ..... 6/01/88
4,801,975 1/31/89 Kano et al. ..... 4/16/87

FOREIGN PATENT DOCUMENTS 414625 2/27/91 EPO .
400996 12/05/90 EPO .
399500 11/28/90 EPO .
391306 10/10/90 EPO .
386978 9/12/90 EPO .
3-68976 3/25/91 Japan .
4139409 6/04/92 Germany .

*Primary Examiner*—R. L. Moses
*Attorney, Agent, or Firm*—Kenyon & Kenyon

[57] ABSTRACT

It has been discovered that a cause of a transfer member winding on an image carrier at the time of transfer is attributable to a discharge in a gap formed between a forward end of the image carrier and a transfer member transporter and is characterized in that the discharge in that gap is ineffectuated by being controlled. An image-forming apparatus capable of preventing not only the winding on the image carrier, but also the fouling of the forward end even when the transfer member is changed in size, is provided by controlling the discharge in the gap. The gap may be ineffectuated by being pressed physically using a guide, thereby preventing the discharge in the gap. As an alternative, the transfer charge amount is controlled in accordance with the position where the forward end of the image carrier passes the transfer element.

31 Claims, 23 Drawing Sheets

IMAGE FORMING APPARATUS CAPABLE OF PREVENTING THE WINDING ON THE IMAGE CARRIER

TECHNICAL FIELD

The present invention relates to an image-forming apparatus such as an electrophotographic duplicator and an electrophotographic printer utilizing the electrostatic transfer process, or more in particular to an image-forming apparatus constructed in such a manner as to prevent the contamination of a transfer member when transported by transfer member transport means and prevents drum trap from occurring when the transfer member passes a transfer point.

BACKGROUND ART

Conventionally, an apparatus using a transfer member transport belt as transfer member transfer means is well known as an image-forming apparatus of this type as shown in FIG. 1.

In FIG. 1, numeral 1 designates a photosensitive drum, numeral 2 a charger, numeral 3 an exposure device, numeral 4 a developer, numeral 5 a transfer charger, numeral 6 an erase lamp, numeral 7 a cleaner, numeral 8 a belt cleaner, numeral 9 a transfer member, numeral 10 a transfer member transport belt, and numerals 11, 12 a belt roller.

The photosensitive drum 1 has arranged therearound various parts including the charger 2, the exposure device 3, the developer 4, the transfer charger 5, the erase lamp 6 and the cleaner 7. The transfer member 9, which is transported by the transfer member transport belt 10, is supplied to a nip region where the photosensitive drum 1 is in contact with the transfer member transport belt 10.

This image-forming apparatus performs the operation described below.

First, the surface of the photosensitive drum 1 is uniformly charged by the charger 2, and is irradiated with light corresponding to the desired image to be formed at the exposure device 3 thereby to form an electrostatic latent image on the surface of the photosensitive drum 1. In the next step, toner is attached on the electrostatic latent image in the developer 4, so that a visible image is formed on the photosensitive drum 1. This visible image is moved to the nip region. The transfer member 9, on the other hand, is supplied from the direction A as indicated by arrow, and disposed on the transfer member transport belt 10 followed by being transported to the nip region by the transfer member transport belt 10. In the nip region, since the charge of a polarity opposite to that of the visible image is applied to the transfer member transport belt 10 from the transfer charger 5, the visible image on the photosensitive drum 1 is transferred onto the transfer member 9 in the nip region. The transfer member 9 with a visible image transferred onto the surface thereof, after being transported over a predetermined distance by the transfer member transport belt 10, is moved along the direction B as indicated by arrow separated from the transfer member transport belt 10, followed by an image being fixed on the surface of the transfer member 9 by means of a fixer (not shown).

The residual charges on the photosensitive drum 1 are erased by the erase lamp 6, and then the residual toner on the photosensitive drum 1 is removed by the cleaner 7 in preparation for a new image-forming cycle.

The toner attached on the transfer member transport belt 10, on the other hand, is removed by the belt cleaner 8.

In the image-forming apparatus as mentioned above, by the way, the transfer member 9 that has passed a transfer point may usually be undesirably wound on the photosentive drum 1 due to various causes as a result of a phenomenon of what is called drum trap.

In the prior art, type, means for preventing drum trap is added. A typical one of such means is an eraser such as an AC corotron disposed at the boundary between the transfer member 9 and the transfer member transport belt 10 to enable the transfer member 9 to easily come off from the transfer member transport belt 10.

Further, as shown in FIG. 1, before transferring a visible image onto the transfer member 9, the transfer member transport belt 10 and the transfer member 9 thereon are charged into opposite polarities by a spare charger 14 and a conductive brush 15 conductively connected with the spare charger 14. As a result, the transfer member 9 is adsorbed electrostatically to the transfer member transport belt 10, thereby preventing the transfer member 9 from being wound on the photosentive drum 1, i.e., the drum trap from occurring. This function is disclosed in JP-A-1-274173.

To achieve the same object, as shown in FIGS. 2A and 2B, a holder 16 with or without a conductive brush 18 grounded conductively through a constant-voltage element 17 is arranged in contact with the transfer member transport belt 10. When the transfer member 9 is supplied, the holder 16 with or without the conductive brush 18 is operated to press the transfer member 9 onto the transfer member transport belt 10. This apparatus is disclosed in JP-A(U)-62-127561.

Another apparatus whose object is different from that of the above-mentioned apparatuses and is to clean the transfer member transport belt is disclosed in JP-A-62-275942, in which a scratch-off blade is arranged in the direction perpendicular to the progress of the transfer member transport belt over the whole belt width thereof to remove paper dust attached on the transfer member transport belt. Still another apparatus having the same object of cleaning the transfer member transport belt is described in JP-A(U)-63-78964 in which a blade element is arranged at an angle to the joint of the transfer member transport belt over the whole effective belt width thereby to clean the surface of the transfer member transport belt.

The means disclosed in JP-A-1-274173 and the one disclosed in JP-A(U)-62-127561 have the problem mentioned below in spite of the fact that both of them have the function to prevent drum trap, i.e., the transfer member 9 from winding on the photosensitive drum 1.

More specifically, in an image-forming apparatus of this type, the transfer member 9 of various sizes or shapes is often selected in accordance with the image to be transferred. Since the transfer member transport belt 10 is preliminarily charged over the whole width thereof regardless of the shape or size of the transfer member 9, the toner which may drop on the transfer member transport belt 10 is stored uniformly over the whole width thereof.

In this case, the toner stored on the transfer member transport belt 10 is attached to the transfer member 9 that has been transported on the transfer member transport belt 10, and with each movement of the transfer member 9, is removed from the surface of the transfer member transport belt 10. If a large transfer member 9 is used after continuous use of a comparatively small transfer member 9, the toner portion that has failed to be removed from the surface of the transfer member transport belt 10 adheres to the forward end of the large transfer member 9 at once, thereby contaminating the the image to be formed.

Conventionally, an electrophotographic recording apparatus equipped with means for preventing the occurrence of the drum trap phenomenon (hereinafter referred to as "the anti-trap means"), as disclosed in JP-A-1-121879, JP-A-1-121878 and JP-A-1-172986, has a separate close-contacting corona charger arranged on a recording paper transporter upstream of the location of a transfer corona charger. The recording paper is brought into close contact with the recording paper transporter immediately before transfer to the recording paper by the close-contacting corona charger (hereinafter referred to as "the close-contact type"). According to another well-known electrophotographic recording apparatus disclosed in JP-A-55-9505, the recording paper is charged to the polarity opposite to that of the recording paper transporter immediately before being placed on the recording paper transporter, so that the recording paper and the recording paper transporter are adsorbed to each other when the former is placed on the latter (hereinafter referred to as "the quasi-close-contact type"). Still another conventional electrophotographic recording apparatus is disclosed in JP-A-61-5256, according to which a recording paper transporter is formed with a plurality of pores, and the recording paper is adsorbed to the recording paper transporter through the pores by a vacuum adsorber after transfer to the recording paper (hereinafter referred to as "the adsorption type"). The recording paper transporter used in the above-mentioned conventional apparatuses is required to hold the charges generated at a corona charger and is comprised of a single- or plural-layer member of plastic film such as urethane rubber or PVDF.

Investigation by the present inventors has revealed that the drum trap occurred in an electrophotographic recording apparatus is caused by the following factors:

First, in the case where no toner image is formed at the forward end portion of the recording paper or especially in the region within at least 20 to 30 mm of the forward end, i.e., when the same region is a blank printing region, the drum trap is liable to occur. When a toner image is formed in the same region, in contrast, the drum trap phenomenon rarely occurs as the result of interposition of toner between the photosensitive member and the recording paper.

Secondly, in the-case where the recording paper is cut paper in the size of A4 or A3 which is obtained by cutting a larger paper into predetermined sizes of paper, what is called a burr occurs with the cut portion (forward end) of the recording paper bent in the cut direction. Also, the forward end at other than the cut portion of the recording paper may be bent or folded for some reason or other. A large burr or bend at the forward end of the recording paper is liable to cause the drum trap. Especially when a burr or bend is transported directed toward the recording paper transporter, the probability of occurrence of the drum trap is considerable.

Thirdly, the frequency of occurrence of the drum trap phenomenon depends on the type of the recording paper, e.g., thickness or quality thereof (whether a high quality paper or recycled paper), the size of a burr or bend being almost the same. Drum trap is liable to occur especially easily with weak paper such as thin or recycled paper. This is also the case with the OHP (overhead projector) sheet such as plastic film used as transfer paper as well as ordinary paper.

Fourthly, the occurrence of drum trap depends on the environmental conditions, and is liable to occur more frequently with a decrease in humidity. Especially when humidity is as low as less than 30% RH, the probability of drum trap is high.

As explained above, the probability of occurrence of the drum trap depends on various factors. In view of this, recent demand is for anti-trap means which is free of the effects of variations in these factors.

All the conventional anti-trap means described above are not designed paying due consideration to these factors. Also, the above-mentioned conventional anti-trap means of close-contact or quasi-close-contact type requires a close-contacting corona charger or a charging roller in addition to a transfer corona charger. Further, the anti-trap means of close-contact type has the problem that a visible image corresponding to a predetermined region at the forward end of the recording paper cannot be transferred. Furthermore, the conventional anti-trap means of adsorption type requires a vacuum adsorber, and has the problem that it is difficult to set the timing of adsorbing the recording paper.

SUMMARY OF THE INVENTION

The present invention has been developed on the basis of the discovery that the winding of the transfer member on an image carrier at the time of transfer of a transfer member is caused by the discharge in the gap formed with the transfer member transport means at the forward end portion of the image carrier, and is characterized in that the discharge in the gap is controlled thereby to ineffectuate the discharge.

The present invention provides an image-forming apparatus which is capable of preventing the winding on an image carrier by controlling the discharge in the gap on the one hand and preventing the fouling of the forward end portion of the transfer member even when the size thereof is changed on the other hand.

In order to achieve the above-mentioned object, according to one embodiment of the present invention, there is provided an image-forming apparatus comprising an image carrier, means for forming a visible image on the image carrier in accordance with the image information projected, transfer member transport means for carrying and transporting a transfer member, transfer means for transferring the visible image to the transfer member at a transfer point where the image carrier and the transfer member transport means are in contact with each other, and winding-prevention means for preventing the transfer member from being transported while being carried on the image carrier after transfer, wherein the winding-prevention means includes first means having a pressure guide in contact with the transfer member transport means upstream of the transfer point and arranged along the width of the transfer member transport means for transporting all sizes of transfer members capable of being handled by the transfer member transport means.

In order to achieve the above-mentioned object, according to another embodiment of the the present invention, there is provided an image-forming apparatus comprising an image carrier, means for forming a visible image on the image carrier in accordance with the image information projected, transfer member transport means for transporting while carrying a transfer member, transfer means for transferring the visible image on the transfer member at a transfer point where the image carrier and the transfer member transport means are in contact with each other, and winding-prevention means for preventing the transfer member from being transported while being carried on the image carrier after transfer, wherein the winding-prevention means includes second means having a pressure guide arranged in contact with and along the width of the transfer member transport means for transporting all sizes of transfer members capable of being handled thereby and an additional guide arranged at another portion along the width of the transfer member transport means.

In order to achieve the above-mentioned object, according to still another embodiment of the present invention, there is provided an image-forming apparatus comprising an image carrier, means for forming a visible image on the image carrier in accordance with the image information projected, transfer member transport means for transporting while carrying a transfer member, transfer means for transferring the visible image to the transfer member at a transfer point where the image carrier and the transfer member transport means are in contact with each other, and winding-prevention means for preventing the transfer member from being transported while being carried on the image carrier after transfer, wherein the winding-prevention means includes third means having a pressure guide arranged along the full width of the transfer member transport means upstream of the transfer point in contact with the transfer member transport means by means of a plurality of protrusions neither parallel nor perpendicular to the direction of progress of the transfer member transport means.

In order to achieve the above-mentioned object, according to a further embodiment of the present invention, there is provided an image-forming apparatus comprising an image carrier, means for forming a visible image on the image carrier in accordance with the image information projected, transfer member transport means for transporting while carrying a transfer member, transfer means for transferring the visible image to the transfer member at a transfer point where the image carrier and the transfer member transport means are in contact with each other, and winding prevention means for preventing the transfer member from being transported while being carried on the image carrier after transfer, wherein the winding prevention means includes fourth means with a pressure guide in contact with the transfer member transport means upstream of the transfer point and arranged along the width of the transfer member transport means, the fourth means further including protrusion means for protruding the transfer member transport means temporarily at the portion thereof contacted by the pressure guide.

In order to achieve the above-mentioned object according to a still further embodiment of the present invention, there is provided an electrophotographic recording apparatus comprising a photosensitive member adapted to be driven at a predetermined speed, an exposure device for exposing the photosensitive member to light, a developer for developing an electrostatic latent image obtained by exposure, and a transfer unit for transferring a developed visible image to the recording paper or the like, wherein the transfer uint includes a charger for electrically charging the recording paper transporter, the charger having fifth means for applying the charges to the recording paper transporter with the arrival of the forward end of the recording paper transported at a nip region, when the amount of the forward end supply charge applied to the region corresponding to the forward end of the recording paper of the recording paper transporter is reduced below the charge amount applied to the regions corresponding to other than the forward end of the recording paper of the recording paper transporter, with the initial charge amount being selected at such a value that the electric field formed in the gap between the recording paper at the forward end and the recording paper transporter by the initial electric charge is reduced below the discharge start electric field of air.

In order to achieve the above-mentioned object, according to a still further embodiment of the present invention, there is provided an electrophotographic recording apparatus comprising a photosensitive member adapted to be driven at a predetermined speed, an exposure device for exposing the photosensitive member to light, a developer for developing the electrostatic latent image obtained by exposure, and a transfer unit for transferring a developed visible image to the recording paper or the like, wherein the transfer unit includes a conductive bias roller for pressuring the recording paper transporter to the photosensitive member, the bias roller having sixth means for applying a voltage to the recording paper transporter with the arrival of the forward end of the incoming recording paper at the nip region, when the forward end voltage applied to the recording paper transporter corresponding to the forward end of the recording paper is reduced below the voltage applied to the recording paper transporter corresponding to other than the forward end of the recording paper, with the forward end voltage selected at such a value that the electric field generated in the gap between the recording paper at the forward end and the recording paper transporter by the forward end voltage is lower than the discharge start electric field of air.

The present invention has been developed on the basis of the knowledge about generation of a drum trap as described above, and the first to fourth means according to the present invention have the functions described below.

First, according to the first means, even when the burr formed at the forward end of transfer member causing a drum trap is carried and transported directed toward the transfer member transport belt, the transfer member is subjected to the pressure of the pressure guide and the shearing stress between the pressure guide and the transfer member transport belt in motion while passing between the pressure guide and the transfer member transport belt. As a result, the size of the burr of the transfer member is reduced while at the same time making it possible to conduct the transfer member, in close contact with the transfer member transport belt, to the nip region providing a transfer point in stable condition. The size and number of the gaps between the transfer member and the transfer member transport belt are thus reduced, and it becomes difficult for the discharge to occur in the gaps, thereby preventing the occurrence of the drum trap.

Also, the pressure guide is arranged only at such portions along the width of the transfer member transport belt where all sizes of transfer member that can be handled by the transfer member transport belt are transported. Therefore, even when toner is stored on the transfer member transport belt and transported between the pressure guide and the transfer member transport belt with the travel of the transfer member transport belt, the toner is removed as it proceeds with the transfer member each time the transfer member passes. As a result, the toner is not accumulated between the pressure guide and the transfer member transport belt, thereby preventing the forward end of the transfer member from being fouled by toner.

According to the second means, the transfer member is guided along the full width of the transfer member transport belt, and the pressure exerted along the width of the transfer member transport belt is selectively changed in width in accordance with the size of the transfer member. As a consequence, the transfer member is effectively guided, and pressure of the pressure guide can be selectively exerted only on the portions of the transfer member transport member used for transportation of the transfer member. Thus the function of drum trap prevention is effectively displayed for all types of transfer members.

The above-mentioned means, for the same reason as for the first means, is free of the problem that the toner on the transfer member transport belt is accumulated between the pressure guide and the transfer member transport belt, thereby preventing the forward end of the transfer member from being fouled by the particular toner.

According to the third means, a plurality of protrusions formed on the pressure guide are constructed in such a manner as to contact the transfer member transport belt. The pressure of the pressure guide is therefore exerted on the transfer member on the transfer member transport belt, so that the function of drum trap prevention is displayed for all types of transfer members.

Also, in view of the fact that a plurality of protrusion means formed on the pressure guide are arranged neither in parallel nor perpendicular to the direction of progress of the transfer member transport belt, the toner, accumulated on the transfer member transport belt, even when moved to the location of the pressure guide, is driven downstream of the transfer member transport belt along the periphery of the protrusion means and thus easily negotiates the pressure guide. As a result, the toner is not accumulated by being stalled at the location of the pressure guide. Thus, as in the preceding case, the forward end of the transfer member is not fouled by the toner.

Finally, according to the fourth means, the pressure guide is so arranged that as in the aforementioned third means, the function of drum trap prevention is exhibited for all types of transfer members.

Further, even when toner is accumulated between the pressure guide and the transfer member transport belt, an arrangement is made to temporarily deform the portion of the transfer member transport belt in contact with the pressure guide while the transfer member is not transported, for example, in advance of initial transfer when the transfer member is changed in size. As a result, the toner accumulated between the pressure guide and the transfer member transport belt is scratched off by the deformation. The toner thus scratched off is moved by the transfer member transport belt, and removed from the surface of the transfer member transport belt by the cleaner. Thus the fouling of the forward end of the transfer member by toner is prevented at the time of first transfer after size change.

According to the present invention, the fifth means mentioned above uses a charger (corona charger) for injecting the charge into the recording paper transporter, whereby the charge applied to the forward end of the recording paper having the burr is selected at an amount Qj smaller than a charge amount Qb, while the charge for other than a forward end of the recording paper is selected at Qm associated with the maximum transfer effieciney.

The sixth means, on the other hand, uses a bias roll for applying a voltage to the recording paper transporter. The bias roll enables the voltage applied to the forward end of the recording paer having the burr to be selected at Vj smaller than the voltage for generating the charge amount Qb, while the charge for other than the forward end of the recording paper is determined at Vm which causes the charge amount Qm maximizing the transfer efficiency.

By employing the fifth or sixth means mentioned above, in spite of the presence of the burr at the forward end of the recording paper, the fact that the charge or voltage applied to the recording paper transporter corresponding to the particular forward end is set in such a manner as to reduce the electric field Eair in the gap to a level smaller than the discharge start electric field Eb of air, prevents the discharge in the gap, so that the recording paper is not wound on the photosensitive member, thereby preventing drum trap from occurring.

As described above, according to the present invention, there is provided an electrophotographic recording apparatus free of a drum trap phenomenon in which the transfer image at the forward end of the recording paper 1040 is not deteriorated and the recording paper is not wound on the photosensitive member.

DETAILED DESCRIPTION

Before the present invention is described, explanation will be made in reference to the conventional apparatus shown in FIG. 1 about the manner in which the use of paper cut into a transfer member, i.e., the cut paper, is related to the occurrence of the winding of the cut paper on the photosensitive drum, i.e., the drum trap.

Figure 23:
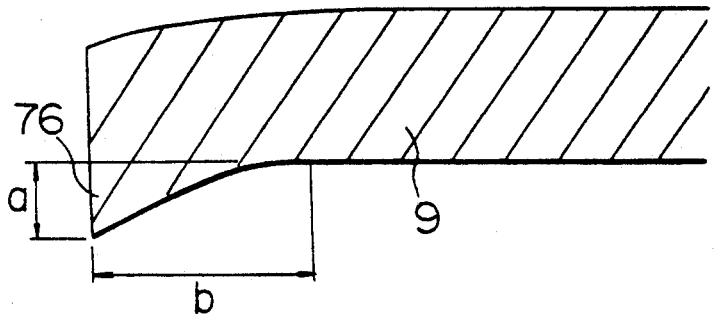
FIG. 23 is a sectional view in enlarged form of a burr at the cut end of cut paper.

Normally, a burr 76 as shown in FIG. 23 is formed in most of the cut paper 9 used in this type of image-forming apparatus at the time of cutting by a cutter. The size of the burr 76 (including portions a, b in FIG. 23) is such that a is about 30 μm or more and b about 200 μm or more for the A4 cut paper measuring 1 $m^2$ and weighing 65 g per sheet.

The present inventors have experimentally confirmed that in the case where the cut paper 9 having the burr 76 at the forward end thereof is placed on the transfer member transport belt 10 and transported to the nip region, drum trap occurs if the burr 76 is directed toward the transfer member transport belt 10, while no drum trap is caused when the burr 76 is positioned toward the photosensitive drum 1.

Figure 24:
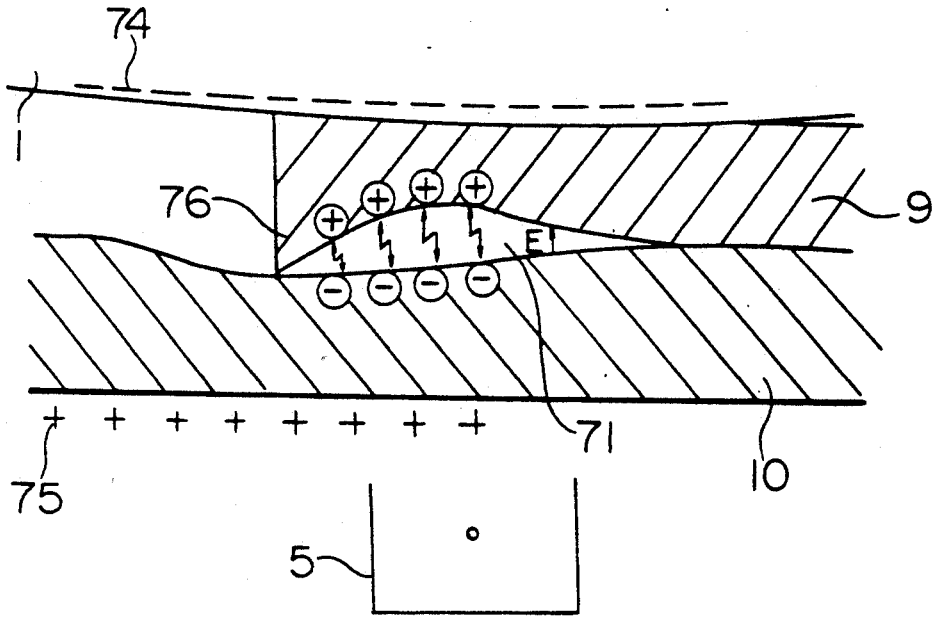
FIG. 24 is a sectional view showing a gap formed between cut paper and a transfer member transport belt for explaining the discharge in the gap.
Figure 27:
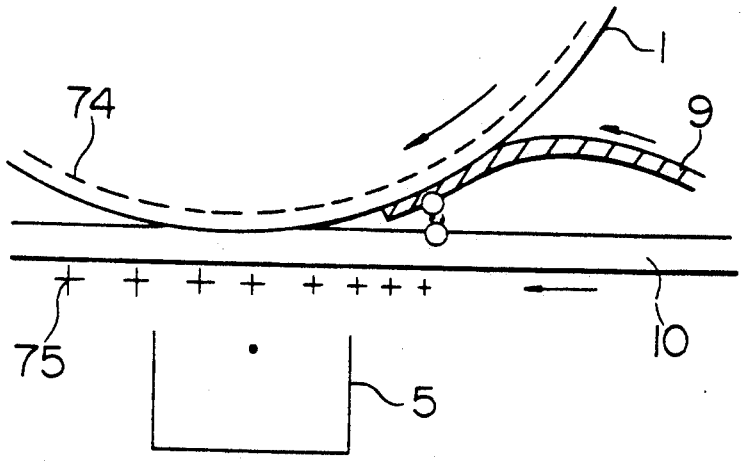
FIG. 27 is a sectional view schematically showing the state of cut paper immediately before reaching the nip region.

The reason is considered to be that when the burr 76 directed toward the transfer member transport belt 10 is transported to the nip region with substantially no toner attached to the photosensitive drum 1, as shown in FIG. 24, a gap 76 is formed between the cut paper 9 and the transfer member transport belt 10, and a high electric field E is generated in the gap 71 of the nip region in the shown direction due to the plus charge 75 on the transfer charger 5 and the minus charge 74 on the photosensitive drum 1, whereby the discharge is caused with the forward end of the cut paper 9 adsorbed to the photosensitive drum 1. In an extreme case, as shown in FIG. 27, the phenomenon occurs in the nip region before the arrival at the nip region so that the forward end portion of the cut paper 9 is already adsorbed to the photosensitive drum 1 before the arrival of the cut paper 9 at the nip region.

Now, the relationship between the burr 76 of the cut paper 9 and the unevenness of the surface thereof will be discussed.

Figure 26:
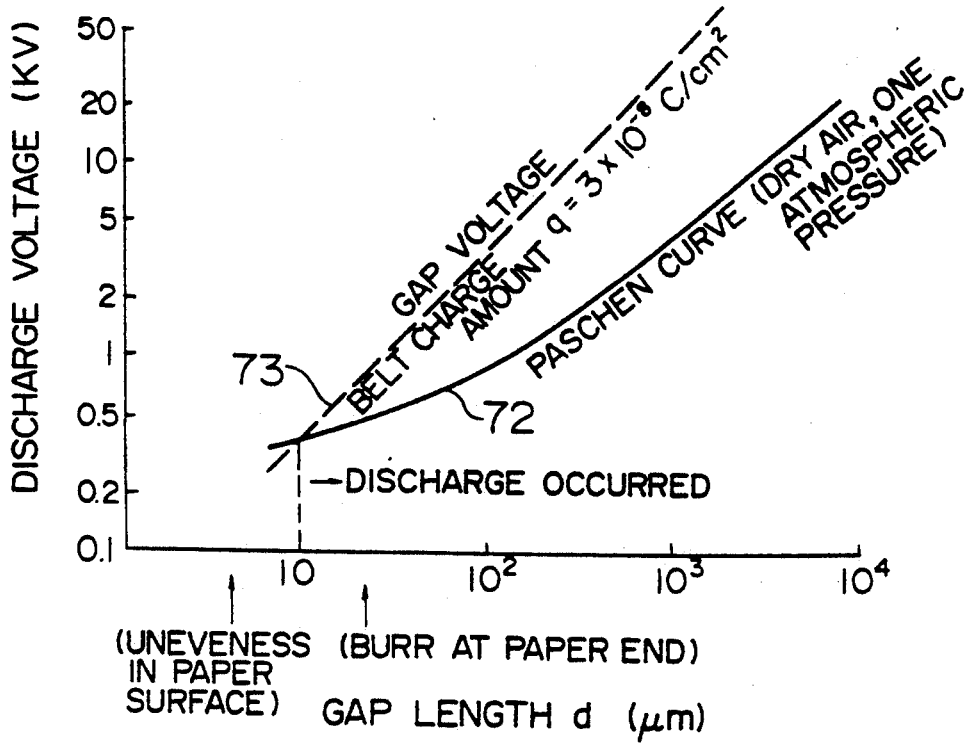
FIG. 26 is a graph showing the relationship between the Paschen curve and the gap voltage against the size of air gap.

FIG. 26 is a graph showing a Paschen curve 72 representing the relationship between the discharge start voltage in the air and the gap length and a line 73 representing the relationship between the air gap with the optimum charge applied to the transfer member transport belt 10 and the gap voltage. This graph indicates that a discharge is generated at a portion with a larger gap length than the one (about 10 μm) at the intersection of the curves 72 and 73.

As a result of measuring the surface unevenness of the A4 cut paper with 55 kg ream weight, it was confirmed that the size thereof is several μm at most. Taking into consideration the data representing the above-mentioned graph and the actual measurements of the burr 76 and the surface unevenness, therefore, it is made clear that the discharge occurs only in the air gap 71 produced by the burr 77 of the cut paper 9 and that the burr 76 is the only cause of a drum trap.

Figure 25:
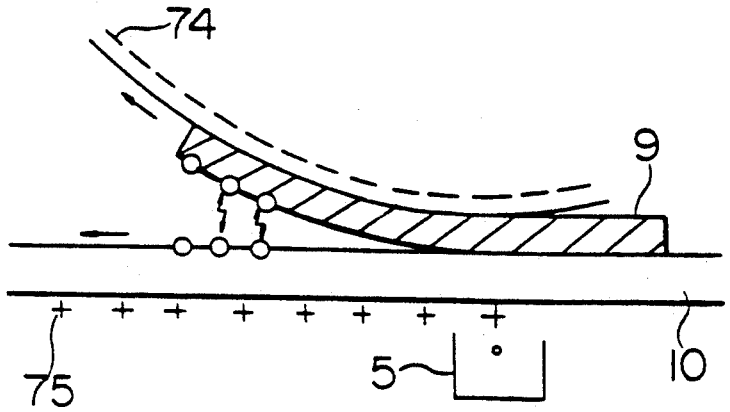
FIG. 25 is a sectional view schematically showing the state of charge held when the cut paper leaves the nip region.

The manner in which the cut paper 9 leaves the nip region is shown in FIG. 25.

In FIG. 25, when substantially no toner is attached on the photosensitive drum 1, i.e., when a considerable amount of minus charge 74 is present on the photosensitive drum 1, a separated discharge as shown occurs if the forward end of the cut paper 9 attached on the photosensitive drum 1 is pulled off from the transfer member transport belt 10. This separated discharge positively charges the portions also other than the forward end of the cut paper 9, and therefore it will be seen that drum trap often occurs.

When a considerable amount of toner is attached on the photosensitive drum 1, i.e., when the minus charge 74 on the photosensitive drum 1 is small in amount, on the other hand, the toner is attracted to the transfer member transport belt 10 through the cut paper 9. At the same time, the increased distance between the photosensitive drum 1 and the cut paper 9 due to the presence of toner weakens the strength of attracting the plus charge of the forward end of the cut paper 9 to the photosensitive drum 1, thereby causing drum trap in lesser frequency.

An embodiment of the present invention will now be described below with reference to the accompanying drawings.

In the description that follows, a printer of electrophotographic type makes up an image-forming apparatus, and cut paper is a transfer member. The image-forming apparatus according to the present invention, however, is not confined in application to the printer of electro-photographic type, but is applicable also to a wide variety of other apparatuses such as duplicators and facsimiles having an electrostatic transfer process.

Figure 3:
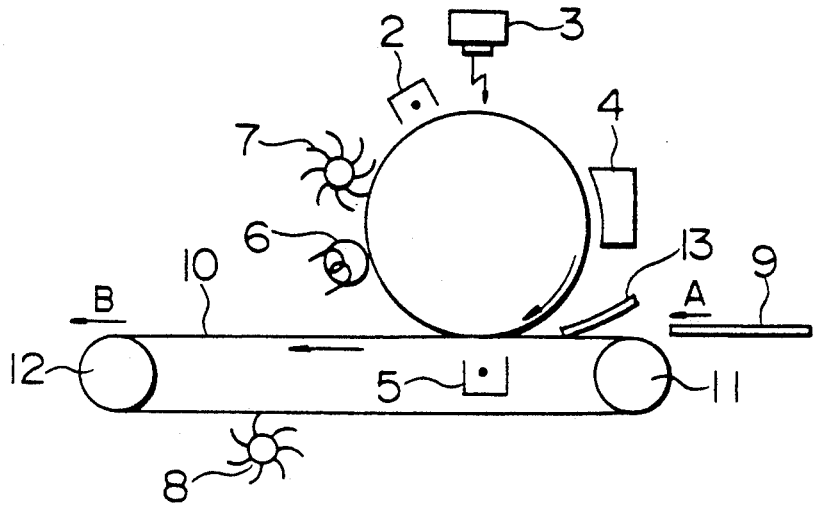
FIG. 3 is a diagram schematically showing a configuration of an image-forming apparatus according to an embodiment of the present invention.

FIG. 3 shows a configuration of a first embodiment of the image-forming apparatus according to the present invention.

In FIG. 3, numeral 1 designates a photosensitive drum, numeral 2 a charger, numeral 3 an exposure device, numeral 4 a developer, numeral 5 a transfer charger, numeral 6 an erase lamp, numeral 7 a cleaner, numeral 8 a belt cleaner, numeral 9 a transfer member, numeral 10 a transfer member transport belt, numerals 11, 12 belt rollers and numeral 13 a pressure guide. All of these component parts are designated respectively by the same reference numerals as the corresponding ones of the conventional apparatus shown in FIG. 1.

Figure 1:
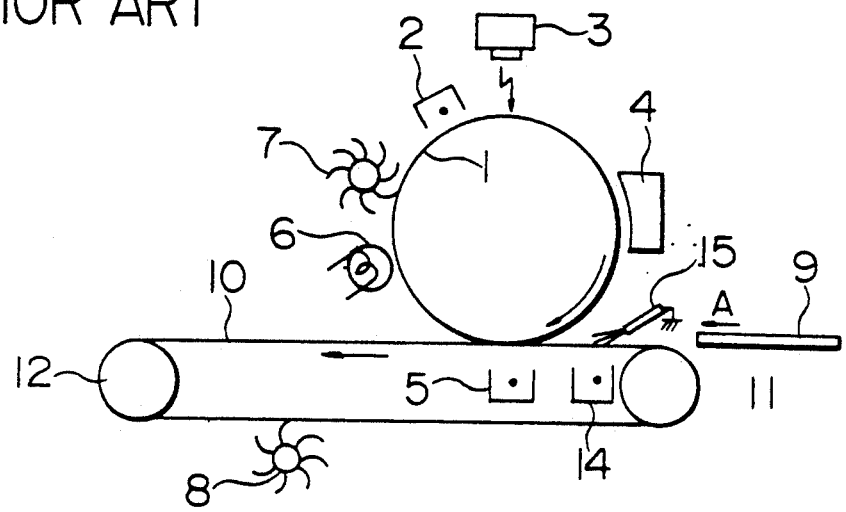
FIG. 1 PRIOR ART
FIG. 1 is a diagram showing a configuration of an example of a conventional image-forming apparatus.
Figure 2A:
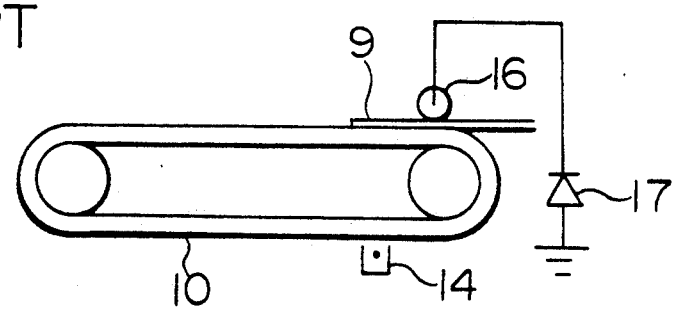
FIG. 2A PRIOR ART
FIGS. 2A and 2B are diagrams schematically showing a configuraion of an example of conventional winding prevention means.
Figure 2B:
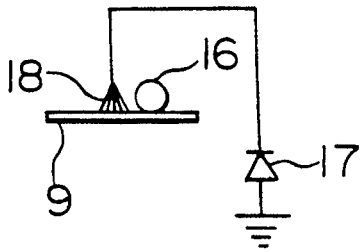
FIG. 2B PRIOR ART

The apparatus according to the present embodiment has the charger 2, the exposure device 3, the developer 4, the transfer charger 5, the erase lamp 6, the cleaner 7 and other component parts arranged around the photosensitive drum 1 in the same manner as in the conventional apparatus shown in FIG. 1. The transfer member 9 is transported by the transfer member transport belt 10 to the nip region where the photosensitive drum 1 and the transfer member transport belt 10 are in contact with each other. The pressure guide 13, which prevents wind up is arranged at a sharp angle to the direction of progress of the transfer member transport belt 10 in contact therewith upstream of the nip region of the transfer member transport belt 10.

The apparatus according to the present embodiment performs basically the same operation as the conventional apparatus shown in FIG. 1.

Specifically, in the first place, a uniform charge is applied to the surface of the photosensitive drum 1 by the charger 2, and light associated with the desired image to be formed is irradiated by the exposure device 3 thereby to form an electrostatic latent image on the surface of the photosensitive drum 1. As the next step, toner is attached on the electrostatic latent image by the developer 4 to form a visible image on the photosensitive drum 1. This visible image is moved to the nip region. The transfer member 9, on the other hand, is supplied from the direction A indicated by the arrow and disposed on the transfer member transport belt 10. It is then transported to the nip region by the transfer member transport belt 10. In the nip region where the transfer member transport belt 10 is charged to the polarity opposite to the charge of the visible image by the transfer charger 5, the visible image on the photosensitive drum 1 is transferred onto the transfer member 9. The transfer member 9 with a visible image transferred to the surface thereof is transported over a predetermined distance by the transfer member transport belt 10 and is separated from the transfer member transport belt 10 in the direction B indicated by arrow, so that an image is fixed on the surface of the transfer member 9 by a fixer (not shown).

The residual charge on the photosensitive drum 1 is erased by the erase lamp 6, and the toner remaining on the photosensitive drum 1 is removed by the cleaner 7 in preparation for a new image-forming cycle. The toner attached on the transfer member transport belt 10, on the other hand, is removed by the belt cleaner 8.

According to the present embodiment, the pressure guide 13 is arranged in contact with the transfer member transport belt 10 immediately before the nip region of the transfer member transport belt 10, and therefore the transfer member 9 is prevented from being wound on the photosensitive drum after passing through the nip region.

According to the present embodiment, the transfer member transport belt 10 is composed of a dielectric belt of urethane rubber coated with fluorocarbon resin on both sides thereof having a surface resistivity of about $10^{12}$ Ω and volume resistivity of about $10^{11}$ Ωcm at normal temperature and humidity. The pressure guide 13, on the other hand, is tabular and made of Mylar film.

Figure 4A:
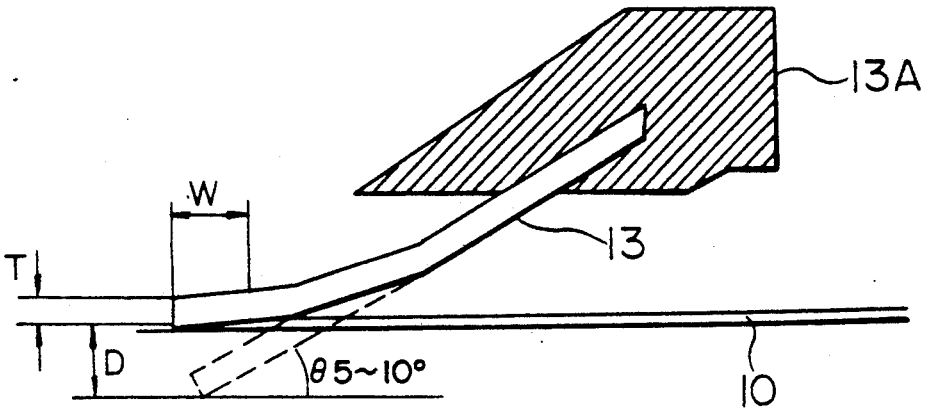
FIGS. 4A and 4B are diagrams schematically showing a positional relationship between a guide and belt according to the embodiment of FIG. 3.

FIG. 4A is a diagram showing a detailed configuration of the guide 13. The guide 13 made of polyester, for example, is mounted at an angle of $\theta$ (about 5 to 10 degrees) by means of a guide support member 13A made of, for example, polycarbonate. The abrasion depth D with the belt 10 about 250 μm thick at the mounting position of the guide is about 2 mm. The guide 13 mounted this way has the forward end thereof brought into contact with the belt 10 with the nip width of about 5 to 15 mm when the belt 10 is set at the position indicated in FIG. 4A.

Figure 4B:
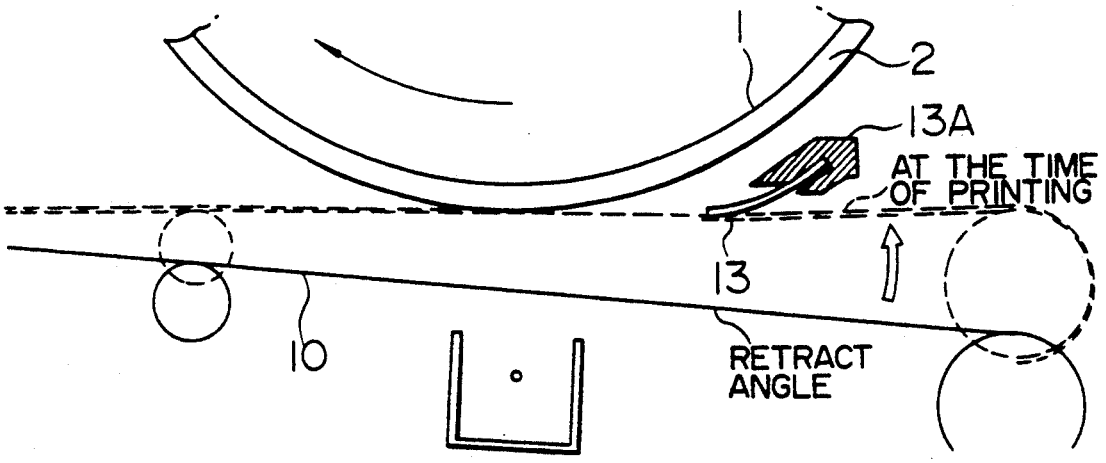

FIG. 4B is a diagram showing relative positions of the guide 13 and the belt 10 while the apparatus is out of operation or no paper is supplied. More specifically, the guide 13 is secured to a printing unit (not shown) together with the drum 1, the charger 2 and the developer 4, while the belt 10 is fixed on a transfer unit (not shown) together with the belt rollers 11, 12 and the belt cleaner 8. As a result, the belt 10, which is positioned as shown by solid line at the time of retraction, assumes a position similar to FIG. 4A as shown by dotted line at the time of printing.

Figure 5:
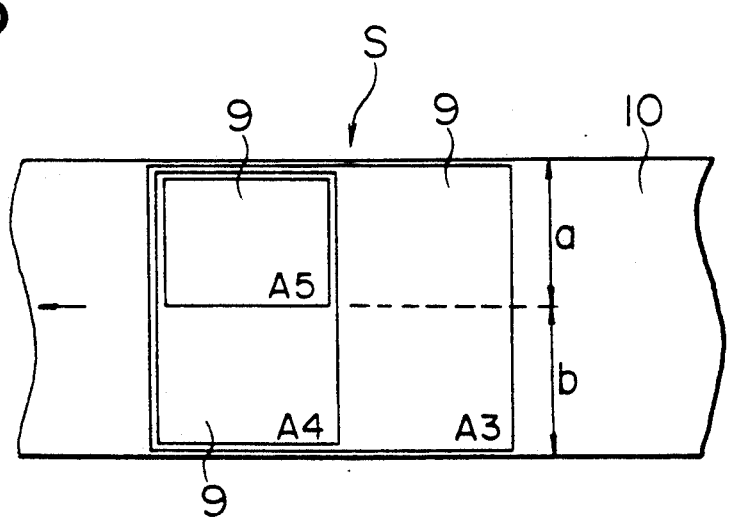
FIG. 5 is a top plan view of an example of arrangement of various sizes of paper on transfer member transport means.

The apparatus according to the present embodiment is assumed to use plain paper of size A3, A4 or A5 as the transfer member 9. FIG. 5 shows the normal position of such plain paper of each size transported by being carried on the transfer member transport belt 10. As seen from FIG. 5, the plain paper 9 of each size is transported along the same side S of the transfer member transport belt 10, and therefore the region a associated with size A5 which is a minimum size of plain paper 9 makes up one where plain paper of all sizes are passed through.

Figure 6:
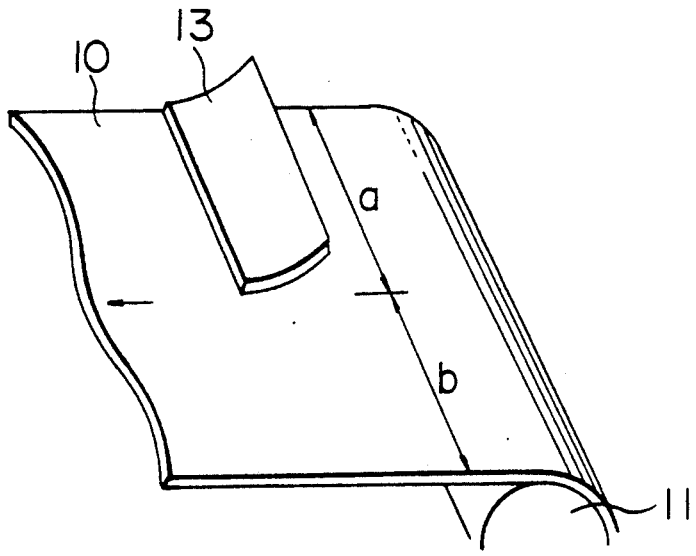
FIG. 6 is a perspective view showing an example of a pressure guide according to the embodiment of FIG. 3.

FIG. 6 is a diagram showing a configuration of the pressure guide 13 used in the present embodiment. The pressure guide 13 has a width commensurate with the region a of the transfer member transport belt 10, and is arranged in the direction perpendicular to the direction of progress of the transfer member transport belt 10 in the region a. The nearer the pressure guide 13 to a transfer point, the higher the effect of drum trap prevention. It is therefore desirable to arrange the pressure guide 13 as near to a transfer point as possible to the extent that toner on the photosensitive drum 1 is not scratched off.

Under normal conditions, the pressure guide 13 is arranged in contact with the transfer member transport belt 10. When the pressure guide 13 is charged by friction with the transfer member transport belt 10 to the polarity reverse to that of the toner, therefore, the toner on the photosensitive drum 1 or floating in the air is attracted, with the result that toner is deposited on the upper surface of the pressure guide 13. The toner thus deposited spills off due to the vibration of the apparatus or the like cause, thereby often fouling the transfer member 9.

As a measure against this, the apparatus should be so constructed that when the pressure guide 13 has friction with the transfer member transport belt 10, the transfer member transport belt 10 is not charged at least to the polarity opposite to the toner. More specifically, when the surface of the transfer member transport belt 10 is composed of fluorocarbon resin, for instance, the surface of the pressure guide 13 is made of at least fluorocarbon resin of Teflon or the like to substantially suppress frictional charge. Such a configuration prevents the toner from being attracted by a frictional charge irrespective of the charge polarity of toner. Also, a Teflon surface of the pressure guide 13 produces a secondary effect of higher mold release characteristic of toner. A sheet of vinylidene polyfluoride (PVDF) may be used as a pressure guide 13.

Figure 13:
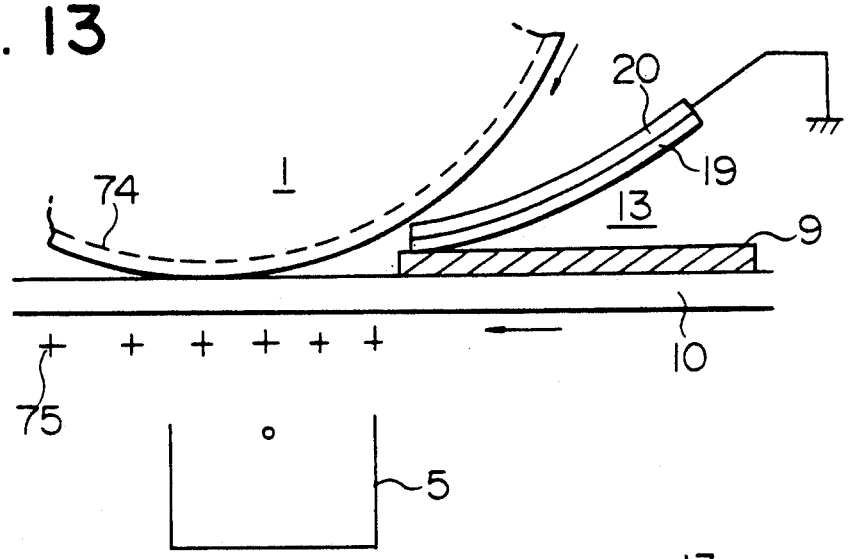
FIG. 13 is a perspective view of another embodiment of a pressure guide.

FIG. 13 is a diagram showing a configuration of another example of the pressure guide 13 used with the apparatus according to the first embodiment.

According to this example, the pressure guide 13 is of a double-layer structure with an aluminum film 20 deposited on the back of a Mylar film 19 by vacuum evaporation. The aluminum film 20 is grounded by a conductive wire. When this pressure guide 13 is arranged in proximity to the nip region, the aluminum thin film 20 functions as an opposite electrode against the transfer charger 5, and therefore the transfer charger 5 is additionally equipped with the same function as the preliminary charger 14 of the conventional apparatus. More specifically, the preliminary charging conducted by the transfer charger 5 which has dual functions of preliminary charging and transfer gives rise to an adsorption force between the plain paper 9 and the transfer member transport belt 10, with the result that the drum trap prevention effect is improved as compared with when the pressure guide 13 of this construction is not used.

The use of a grounded aluminum thin film 20 as a pressure guide 13 as shown above may cause a transfer failure due to the lack of effective generation of a transfer electric field, especially in the case where the plain paper 9 has a high hygroscopic degree and a low resistance. At least the side of the pressure guide in contact with the transfer member transport belt 10 is therefore desirably constructed of an insulating material.

If the aluminum thin film 20 is not grounded but impressed with a potential of a polarity opposite to the polarity of the transfer member transport belt 10 due to the transfer charger 5, the above-mentioned spare charging function is further strengthened.

Further, the configuration of the pressure guide 13 is not limited to the above-mentioned examples but other appropriate configurations may of course be employed with equal effect.

Figure 14:
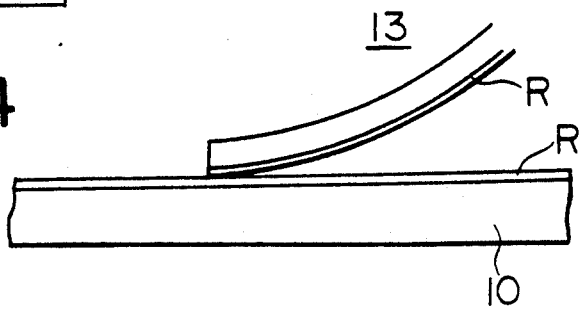
FIG. 14 is a perspective view of still another embodiment of a pressure guide.

FIG. 14 shows another example of the material Of the guide 13 and the belt 10. By forming layers R of a material small in coefficient of friction such as Teflon on the contacting surfaces, the generation of frictional static electricity and the wear of the belt and guide due to mutual friction are prevented.

Figure 7:
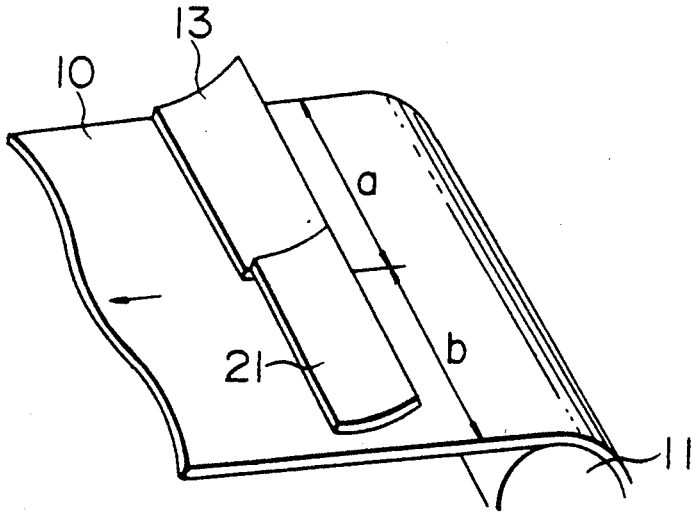
FIG. 7 is a perspective view showing another embodiment of a pressure guide.

FIG. 7 shows a configuration of a pressure guide arranged together with an additional fixed guide according to a second embodiment of the present invention.

According to this embodiment, the configuration of the parts other than the pressure guide and the additional fixed guide is not shown.

In FIG. 7, numeral 21 designates an additional fixed guide, and all the other component parts are designated by the same reference numerals as corresponding parts respectively of the above-mentioned embodiments.

The additional fixed guide 21 is arranged in juxtaposition with the pressure guide 13 in the region b shown in FIG. 5, and is fixed out of contact with the transfer member transport belt 10. In this arrangement, the gap between the additional fixed guide 21 and the transfer member transport belt 10 is set to, say, about 1 mm.

The juxtaposed configuration of the additional fixed guide 21 and the pressure guide 13 prevents the plain paper 9 transported by the transfer member transport belt 10 from coming into close contact with the photosensitive drum 1 before arriving at the nip region as shown in FIG. 27, thereby making it possible to lead the full surface of the plain paper 9 to the nip region in stable fashion.

According to the present embodiment, the plain paper 9 is prevented from being charged to the polarity opposite to the charge 74 on the surface of the photosensitive drum 1 by the gap 71 formed between the plain paper 9 and the transfer member transport belt 10 before arriving at the nip region. Therefore, as compared with the first embodiment, the effect of drum trap prevention is further improved.

Also, a guide 13 having a construction as shown in FIG. 13 may be used for the pressure guide 13 and/or the additional fixed guide 21 according to the present embodiment.

Figure 8:
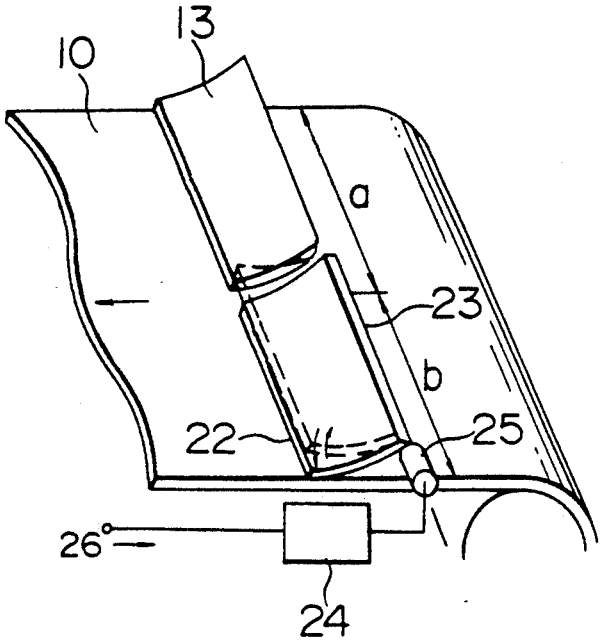
FIG. 8 is a perspective view showing still another embodiment of a pressure guide.

FIG. 8 shows a configuration of a pressure guide used with an additional guide selectively switchable between contact and non-contact states (hereinafter referred to as "the selective additional guide") according to a third embodiment of the present invention.

In this embodiment, the configuration of the parts other than the pressure guide and the selective additional guide is not shown.

In FIG. 8. numeral 22 designates a selective additional guide, and the remaining component parts are designated by the same reference numerals as the corresponding ones respectively in the above-mentioned embodiments.

The selective additional guide 22 is arranged in juxtaposition with the pressure guide 13 in the region b shown in FIG. 5 as in the second embodiment, and is capable of assuming either of two states: contact with the transfer member transport belt 10 or non-contact with that belt. One side of the selective additional guide 22 is coupled to a shaft 23. Upon energization of a pulse motor 25 by a signal 26 representing the type of paper size from a control unit 24, the pulse motor 25 drives the shaft 23 coupled thereto in the direction indicated by arrow, thereby bringing the selective additional guide 22 into the contact or non-contact state selectively. The selective additional guide 22 is so constructed as not to be in contact with the photosensitive drum 1 during rotation. Therefore, the photosensitive drum 1 is prevented from being damaged or worn on the one hand and the toner remaining on the photosensitive drum 1 without being cleaned is prevented from being accumulated on the guide 13 on the other hand.

The apparatus according to the present embodiment is also assumed to use plain paper 9 of size A3, A4 or A5 as in the first or second embodiment. The pressure guide 13 permanently functions in the region a where the plain paper of various sizes is transported. Also, during non-transportation of the plain paper 9 and the transportation of plain paper 9 of size A5, the selective additional guide 22 is relocated to the position where the transfer member transport belt 10 is not contacted. The selective additional guide 22 is moved to the position where the transfer member transport belt 10 is contacted, however, during the period-when at least the forward end of the plain paper 9 of size A3 or A4 is passed.

The determination of the size of the plain paper 9 transported is made by use of a signal 26 representing the type of paper size in the print data sent to the apparatus from an external source. In response to this signal 26, the control unit 24 drives the pulse motor 25 thereby to energize the rotational operation of the selective additional guide 22. As an alterantive, a sensor to determine the paper size may be included in the apparatus, and the control unit 24 operated on the basis of the sensor signal.

According to this embodiment, like the second embodiment, there are set two regions including a region a shared by various sizes of plain paper 9 transported and the remaining region designated as b. Although only one selective additional guide 22 is included, an increased number of selective addtional guides 22 may be used in accordance with the number of the regions b which may be two or more for each size of the plain paper 9.

The inventors have confirmed experimentally that the use of the guide 13 configured as shown in FIG. 13 according to the present embodiment makes it easy for the toner on the transfer member transport belt 10 to pass under the guide 13 even when the selective additional guide 22 is kept in contact with the transfer member transport belt 10 in the region b where the plain paper 9 is not always transported, thus reducing the toner accumulated at the position where the guide 13 is arranged.

Figure 9:
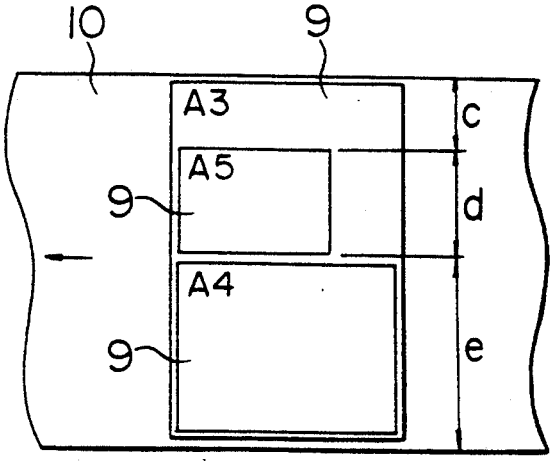
FIG. 9 is a top plan view showing an example of an arrangement of various sizes of paper on a transfer member transport means.

The third embodiment is divided roughly into the region a covered by the plain paper 9 of all sizes transported and the region b other than region a. The pressure guide 13 is used for the region a, and the selective additional gudie 22 for the region b. Some apparatuses of this type have not any region a covered by the plain paper 9 of all sizes in transportation. In the apparatus shown in FIG. 9, the plain paper 9 of size A5 is transported only in the region d, the plain paper of size A4 only in the region e, and the plain paper 9 of size A3 in all the regions c, d and e.

Figure 10:
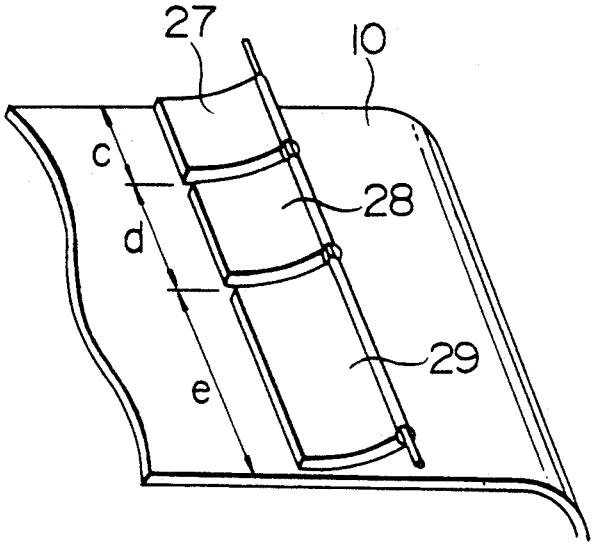
FIG. 10 is a perspective view showing a further embodiment of a pressure guide.

FIG. 10 shows a configuration of selective additional guides arranged in the regions c, d and e according to a fourth embodiment of the present invention.

In this embodiment, the configuration of other than the selective additional guides is not shown.

In FIG. 10, numerals 27, 28, 29 designate selective guides, i.e., additional guides switchable between contact and non-contact states. The other component parts corresponding to those of the above-mentioned embodiments are designated by the same reference numerals respectively.

According to the present embodiment, the selective additional guides 27, 28 and 29 are arranged at positions corresponding to the regions c, d and e respectively. The plain paper 9 is pressed against the transfer member transport belt 10 by energizing only the selective additional guide 28 when the plain paper 9 of size A5 is transported, only the selective additional guide 29 when the plain paper 9 of size A4 is transported, and all the selective additional guides 27, 28 and 29 when plain paper of size A3 is transported. The rotation of these selective additional guides 27, 28, 29 is controlled in the same manner as in the third embodiment. According to the present embodiment, however, the turning effort of the main shaft of the pulse motor 25 is transmitted selectively to the selective additional guides 27, 28, 29 by selection of the engagement between the gear mounted on the main shaft of the pulse motor 25 and the gear mounted on the Coupling shaft of the selective additional guides 27, 28, 29. Incidentally, a single selective additional guide may be provided and selectively moved along the width of the transport belt.

Figure 11:
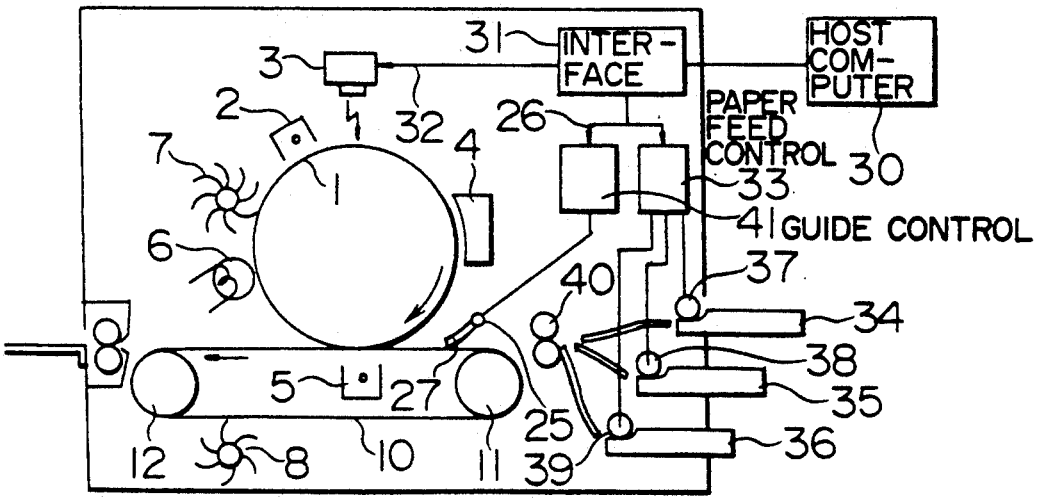
FIG. 11 is a diagram showing a configuration of another example of a control system for operating a selective additional guide.

FIG. 11 is a diagram showing a configuration of an example of an image-processing apparatus including a control system for operating the selective additional guides 27, 28, 29 according to the present embodiment.

In FIG. 11, numeral 30 designates a host computer, numeral 31 an interface, numeral 32 an image signal, numeral 33 a paper feed control unit, numeral 34 a size-A3 paper tray, numeral 35 a size-A4 paper tray, numeral 36 a size-A5 paper tray, numerals 37 to 39 paper feed pulse motors, numeral 40 a paper transport roller, and numeral 41 a pressure guide control unit. Other component parts corresponding to those in the above-mentioned embodiments are designated by the same reference numerals respectively.

In printing information this image-processing apparatus, an image signal 32 to be printed from the host computer 30 and a signal 26 representing the type of paper size to be used are applied to the interface 31, which in turn supplies the image signal 32 to the exposure device 3 and the signal 26 representing the type of paper size to the paper feed cotnrol unit 33. The paper feed control unit 33 selectively drives one of the paper feed pulse motors 37 to 39 by designation of the signal 26, so that the plain paper suitable for the paper size to be used is taken out from the corresponding one of the trays 34 to 36. The plain paper 9 thus taken out is placed on the transfer member transport belt 10 through the paper transport roller 40.

In the process, upon decision that the size of the plain paper 9 is A3 or A4 in accordance with the signal 26, the pressure guide control unit 41 drives the control pulse motor 25 in such a manner that the selective additional guides 27 to 29 or only the guide 29 is in contact with the transfer member transport belt 10 at least during the arrival of the forward end portion of the plain paper 9, while at the same time selecting a desired gear engagement to attain such a contact. In similar fashion, upon decision that the plain paper 9 is of size A5, on the other hand, the selective additional guide 28 is controlled to contact the transfer member transport belt 10 at least during the arrival of the forward end portion of the plain paper 9.

Figure 12:
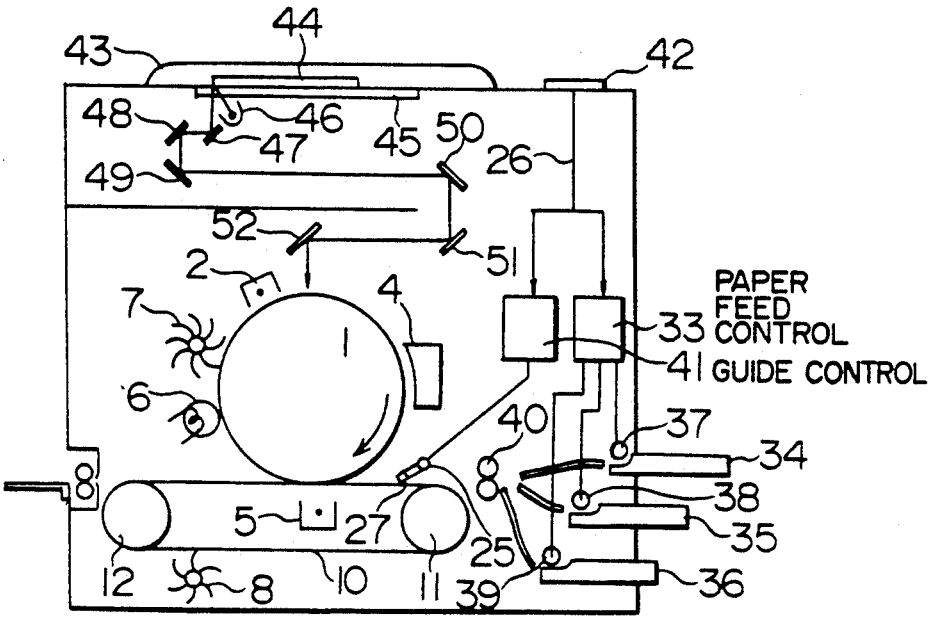
FIG. 12 is a diagram showing a configuration of another example of a control system for operating a selective additional guide.

FIG. 12 is a diagram showing a configuration of another example of the image-processing apparatus including a manual control system for operating the selective additional guides 27, 28, 29.

In FIG. 12, numeral 42 designates a copy mode setting panel, numeral 43 a masking cover, numeral 44 an original to be copied, numeral 45 a sheet of glass, numeral 46 a light source, and numerals 47 to 52 reflection mirrors. The other component parts corresponding to those in the above-mentioned embodiments are designated by the same reference numerals respectively.

The present example has an exposure device different from the one included in the preceding example, and is of such a type that the scanning image obtained from the original 44 is supplied through the reflection mirrors 47 to 52. The image-forming operation according to this example is similar to the one mentioned above, and therefore will not be explained below.

In this example, the size of the paper and an image formed at the time of copying are set by the copy mode setting panel 42, which generates a signal 26 representing the size of the paper to be used on the basis of such a setting. In this example, therefore, the apparatus is controlled in the same manner as in the above-mentioned examples.

According to this embodiment, the selective additional guides 27, 28, 29 are not in contact with the transfer member transport belt 10 all the time, but only those of the selective additional guides 27, 28, 29 suited for the size of the plain paper 9 to be transported are kept temporarily in contact with the transfer member transport belt 10. As a result, the selective additional guides 27, 28, 29 are configured in simple fashion. Also, since the selective additional guides 27, 28, 29 are not in contact with the transfer member transport belt 10 all the time, no toner is accumulated on the arrangement of the selective additional guides 27, 28, 29.

As regards the selective additional guide 22 according to the third embodiment shown in FIG. 8, the use of the control system shown in FIG. 11 or 12 obviously makes possible a similar control.

Figure 15A:
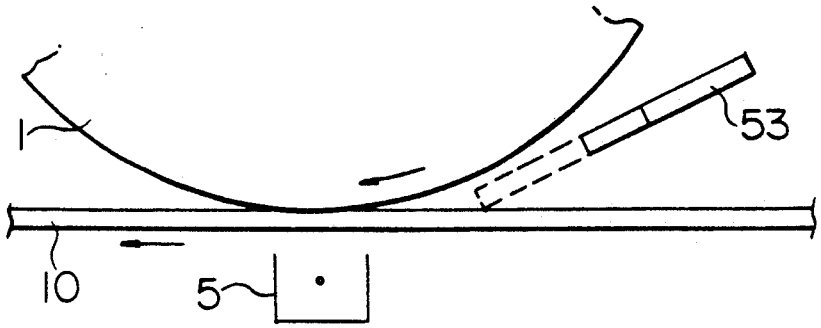
FIGS. 15A, 15B and 15C are perspective views of other embodiments of a pressure guide.

The selective additional guides 22, 27, 28, 29 according to the third and fourth embodiments, which use a shaft 23 connected thereto to be rotated as a support, are not limited to the configuration mentioned above, but may be configured movably with the ability to extend and retract in a predetermined direction as shown in FIG. 15A.

More specifically, when a selective additional guide 53 shown in FIG. 15A is used, the photosensitive drum 1 is not contacted even when the transfer member transport belt 10 is out of contact, and the plain paper 9 can be pressed against the transfer member transport belt 10 in the immediate vicinity of the nip region.

Figure 15B:
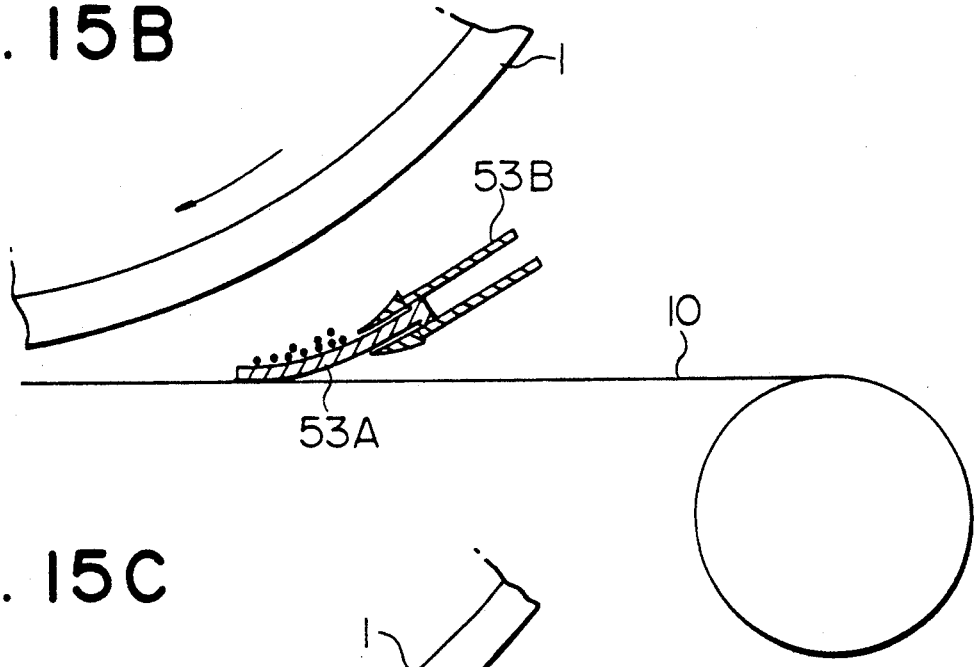
Figure 15C:
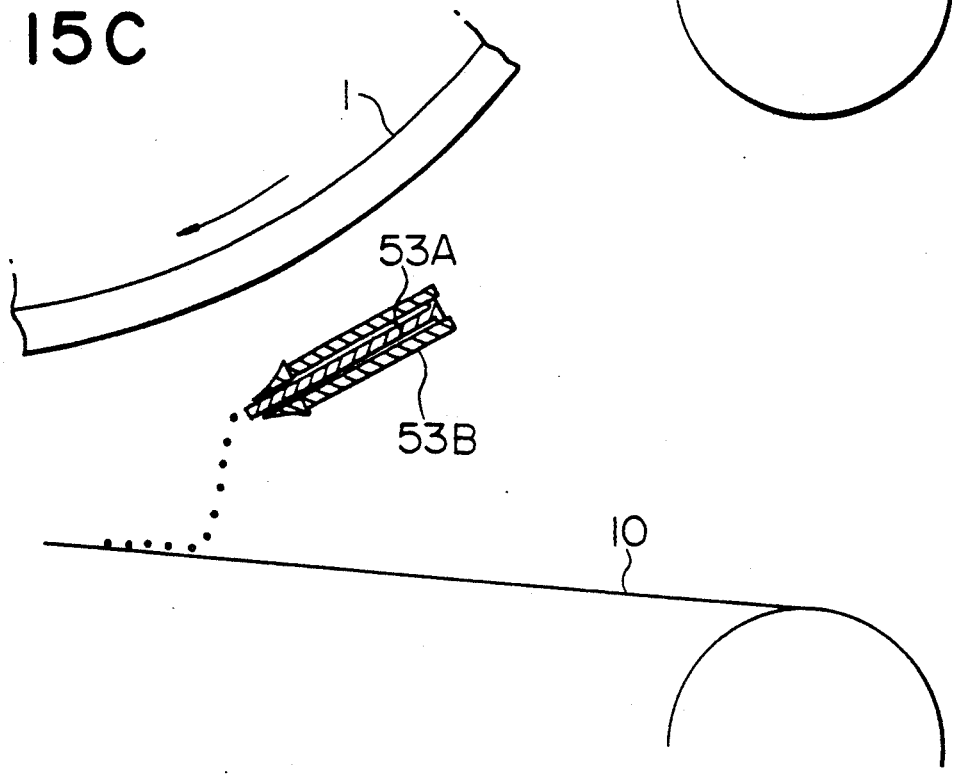

FIGS. 15B and 15C show a modification of the guide. The guide shown in FIG. 15A, which is normally operated in contact with the belt 10, has the disadvantage that unrequired toner attaches to the upper surface of the guide 53 and part of the toner drops on the transfer paper, thereby reducing the image quality. Nevertheless, according to the modification shown in FIGS. 15B and 15C, at the time of retraction when the belt 10 is separated from the drum 1, the guide 53A is automatically pulled into the guide support 53B, and therefore the toner is removed from the upper surface of the guide and drops on the belt 1. The toner thus dropped is cleaned by the belt cleaner 8. In response to the return of the belt 10 from retraction to print mode, the guide 53A is automatically pulled out of the guide support 53B into a state ready for operation as shown in FIG. 15B.

Figure 16:
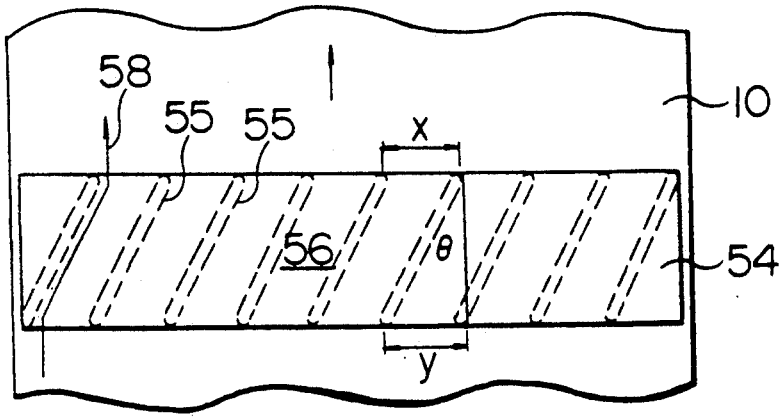
FIG. 16 is a perspective view of still another embodiment of a pressure guide.
Figure 17:
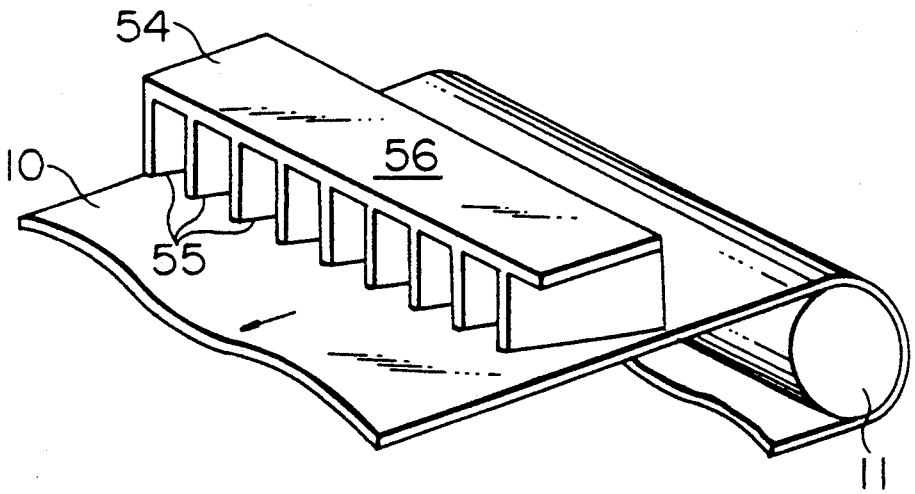
FIG. 17 is a perspective view of a further embodiment of a pressure guide.

FIGS. 16 and 17 show a top plan view and a perspective view respectively of a fifth embodiment of the present invention having a different configuration of the pressure guide.

In this embodiment, the component parts other than the selective additional guide are not shown.

In FIGS. 16 and 17, numeral 54 designates a guide body, and numeral 55 guides. The remaining reference numerals designate corresponding component parts respectively designated by the same reference numerals in the above-mentioned embodiments.

According to this embodiment, a plurality of guides 55 under the guide body 54 make up a pressure guide 56. The guides 55 are arranged at a predetermined angle $\theta$ ($\neq 90°$) to the direction of progress of the transfer member transport belt 10, so that at least one of the guides 55 is in contact with substantially the whole region along the width of the transfer member transport belt 10. This pressure guide 56 is made of Teflon and pressed against the transfer member transport belt 10 under a predetermined pressure by a spring 57 as shown in FIG. 18.

A pressure guide 56 of the above-mentioned shape prevents the drum trap which otherwise might be caused by a displacement of the forward end of the plain paper 9 as in each of the embodiments mentioned above, in view of the fact that the plain paper 9 transported on the transfer member transport belt 10 has at least the forward end thereof pressed uniformly along substantially the whole width of the transfer member transport belt 10. Also, even when there remains toner in that region on the transfer member transport belt 10 where the plain paper 9 is not transported for a comparatively long time, the residual toner is moved in the direction indicated by arrow 58 along the edge of the guides 55 of the pressure guide section 56. Toner therefore is not accumulated on the arrangement of the pressure guide 56. Further, if the pressure guide 56 is made of Teflon, the frictional charging is prevented on the one hand and the toner release is faciliated for smooth toner movement on the other hand.

Figure 18:
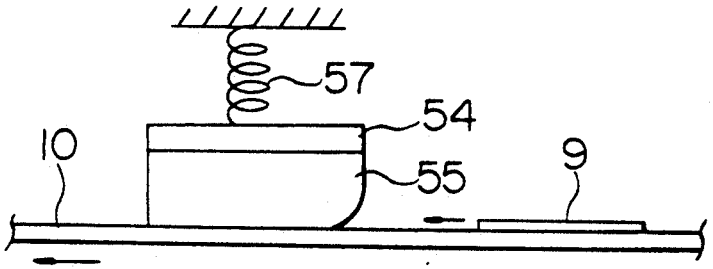
FIG. 18 is a perspective view of a still further embodiment of a pressure guide.

According to this embodiment, in order to transport the plain paper 9 smoothly, as shown in FIG. 18, the pressure guide 56 is suitably formed in such a manner that the end of each guide 55 upstream of the transfer member transport belt 10 is curved with a radius of curvature larger than the thickness of the plain paper 9. Also, in order to improve the drum trap prevention even more, the distance x between adjacent guides 55 is preferably reduced to a length smaller than the length y of the guide 29 along the width of the transfer member transport belt 10 so that each guide 55 is uniformly pressed along the width of the transfer member transport belt 10.

After long use of the pressure guide 56, the Teflon guide 55 will be worn. The wear varies between the point where the common paper 9 passes often and the point where it passes less often. The pressure may thus vary from one place to another. As in the fourth embodiment, therefore, the pressure guide 56 may be divided into portions corresponding to the transport regions of the plain paper 9 and pressed against the transfer member transport belt 10 under a predetermined pressure by the spring 57 respectively. In the process, even when the pressure guides 57 are worn to different degrees, pressure is not varied, thereby effectively preventing drum trap.

Figure 19:
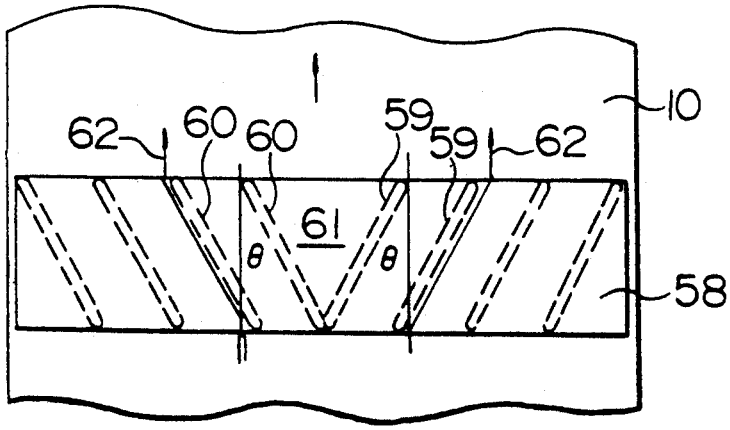
FIG. 19 is a perspective view of a further embodiment of a pressure guide.

FIG. 19 is a diagram showing a configuration of a second example of the pressure guide with guides arranged at different positions.

In this example, too, the component parts other than the selective additional guide are not shown.

In FIG. 19, numeral 58 designates a guide body, and numerals 59, 60 guides, the remaining component parts being designated by the same reference numerals as the corresponding parts respectively in the above-mentioned embodiments.

According to this example, a plurality of guide pairs 59, 60 are arranged under the guide body 58 and constitute a pressure guide 61. The guides 59 are constructed at a predetermined angle $\theta$ ($\neq 90°$) to the direction of progress of the transfer member transport belt 10 and the other set of guides 60 in the opposite direction at an angle of $-\theta$ to the progress of the transfer member transport belt 10, whereby at least one of the guides 59, 60 is in contact with substantially the whole width of the transfer member transport belt 10. The pressure guide 61 is also pressed against the transfer member transport belt 10 under a predetermined pressured by the spring 57 as shown in FIG. 18.

This example also has an effect of drum trap prevention as in the above-mentioned embodiments. Also, the residual toner is moved in the direction of arrow 62 on the transfer member transport belt 10 in the same manner as in the above-mentioned embodiments, and is not accumulated on the arrangement of the pressure guide 61.

When the pressure guide 61 of a shape as shown in this example is used, the force perpendicular to the direction of transportation of the plain paper 9, i.e., such a tension as to flatten the plain paper 9 and the transfer member transport belt 10 is exerted on the plain paper 9 and the transfer member transport belt 10 in contact with the pressure guide 61, thereby producing the secondary effect of preventing wrinkles or the like. In this case, if an arrangement is made to keep the same number of guides 59, 60 in contact with all sizes of the plain paper 9, the plain paper 9 is subjected to the same magnitude of force in two directions at right angle to the direction of transportation, thereby displaying the maximum effect mentioned above. In this example, toner is of course rejected as in the above-mentioned examples if the pressure guide 61 is made of Teflon.

According to this example, the pressure guide 61 may be divided in the same manner as in the preceding examples.

Figure 20:
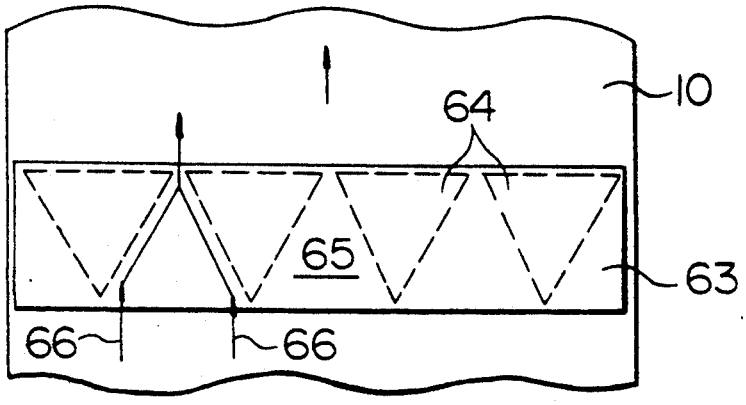
FIG. 20 is a perspective view of still another embodiment of a pressure guide.

FIG. 20 is a diagram showing a configuration of the third example of the pressure guide with the individual guides arranged differently.

In this example, too, the component parts of other than the selective additional guide are not shown.

In FIG. 20, numeral 63 designates a guide body, and numeral 64 a guide section. The remaining component parts are designated by the same numerals as the corresponding parts respectively of the above-mentioned embodiments.

In this example, a plurality of triangular guides 64 are arranged under the guide body 63 and constitute a whole pressure guide 61. These triangular guides 64 are configured in such a manner that at least one of them is in contact with substantially the whole region along the width of the transfer member transport belt 10. The pressure guide 65 is also pressed against the transfer member transport belt 10 under a predetermined pressure by the spring 57 as shown in FIG. 18.

According to this example, as in the above-mentioned examples, the effect of drum trap prevention is attained, and the residual toner, as in the above-mentioned examples, is moved in the direction of arrow 86 on the transfer member transport belt 10 without being accumulated on the arrangement of the pressure guide 65. Further, a Teflon-made pressure guide 65 rejects toner as in the above-mentioned examples.

Figure 21:
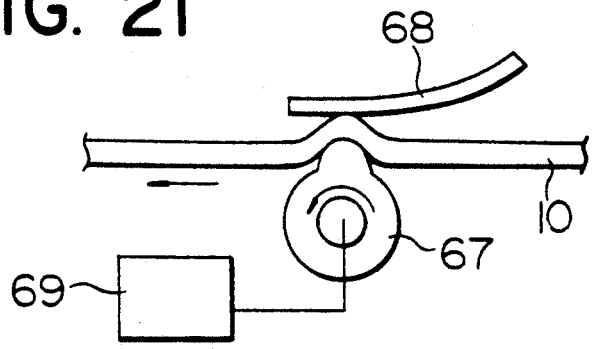
FIG. 21 is a diagram schematically showing a configuration of a toner remover means.

FIG. 21 is a diagram showing a configuration of a sixth embodiment of the present invention so constructed that a protrusion means is operated temporarily before transportation of the plain paper 9 making up a transfer member to remove the toner accumulated on the pressure guide.

In this embodiment, too, the component parts other than the pressure guide and those related directly thereto are not shown.

In FIG. 21, numeral 67 designates a roller making a protrusion means, numeral 68 a pressure guide of Mylar film, and numeral 69 a roller control unit. The remaining component parts corresponding to those in the above-mentioned embodiments are designated by the same numerals correspondingly.

According to the present embodiment, a roller 67 having a protruded part is arranged under the transfer member transport belt 10 on the pressure guide 68 and is controlled by the roller control unit 69.

More specifically, the roller control unit 69, while the plain paper is being transported, relocates and fixes the protrusion of the roller 67 at a position where the transfer member transport belt 10 is not pushed up. When the plain paper 9 is not transported or a transportation interval of the plain paper 9 falls at the pressure position of the pressure guide 68, the roller 67 is driven as shown with the protrusion thereof deforming the transfer member transport belt 10 locally, thereby scratching off the toner accumulated between the pressure guide 68 and the transfer member transport belt 10. In the process, in order not to damage the transfer member transport belt 10, the peripheral speed thereof is desirably set to the same level as feed rate thereof.

According to the present embodiment, the pressuring operation of the plain paper 9 by the pressure guide 68 secures the effect of drum trap prevention on the one hand and scratches off and removes by the transfer member transport belt 10 the toner accumulated between the pressure guide 68 and the transfer member transport belt 10 by the operation of the roller 67 with a protrusion on the other hand. The toner thus removed is cleaned off the belt cleaner.

The protrusion mentioned above may alternatively be elliptic or flat oval in cross section with equal effect.

Figure 22:
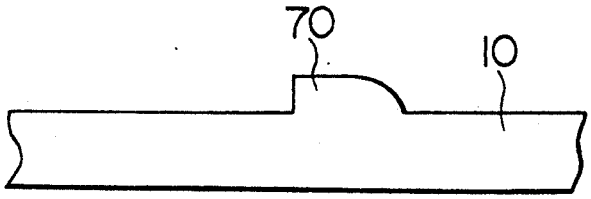
FIG. 22 is a diagram schematically showing a configuration of another example of a toner remover means.

Further, FIG. 22 shows a configuration of another example of the protrusion means using a transfer member transport belt 10 having a protrusion 70 on the surface thereof in place of the roller 67 with a protrusion.

In this example, too, the component parts other than the transfer member transport belt 10 are not shown.

In FIG. 22, numeral 70 designates a protrusion formed at a part of the surface of the transfer member transport belt 10. The remaining component parts are designated by the same reference numerals as the corresponding parts respectively of the above-mentioned embodiments.

In the present example, toner accumulated between the pressure guide (not shown) and the transfer member transport belt 10 is scratched off at the same timing and by the same operation as in the above-mentioned examples, thereby preventing the toner from being accumulated on the transfer member transport belt 10.

In the process, in order to drive the transfer member transport belt 10 smoothly and to prevent the photosensitive drum 1 from being damaged, the height of the protrusion 70 is set to less than several millimeters with fluorocarbon resin deposited by vacuum evaporation on the surface of the transfer member transport belt 10. Also, in order to prevent the plain paper 9 from stalling on the protrusion 70 and causing a transfer failure at a transfer point, the transport timing of the plain paper 9 is controlled in such a manner that the protrusion 70 is positioned in a transport interval of the plain paper 9 as in the above-mentioned embodiments.

Now additional explanation will be provided regarding a mechanism that also causes the phenomenon of drum trap of the recording paper having a burr or bend.

Figure 37:
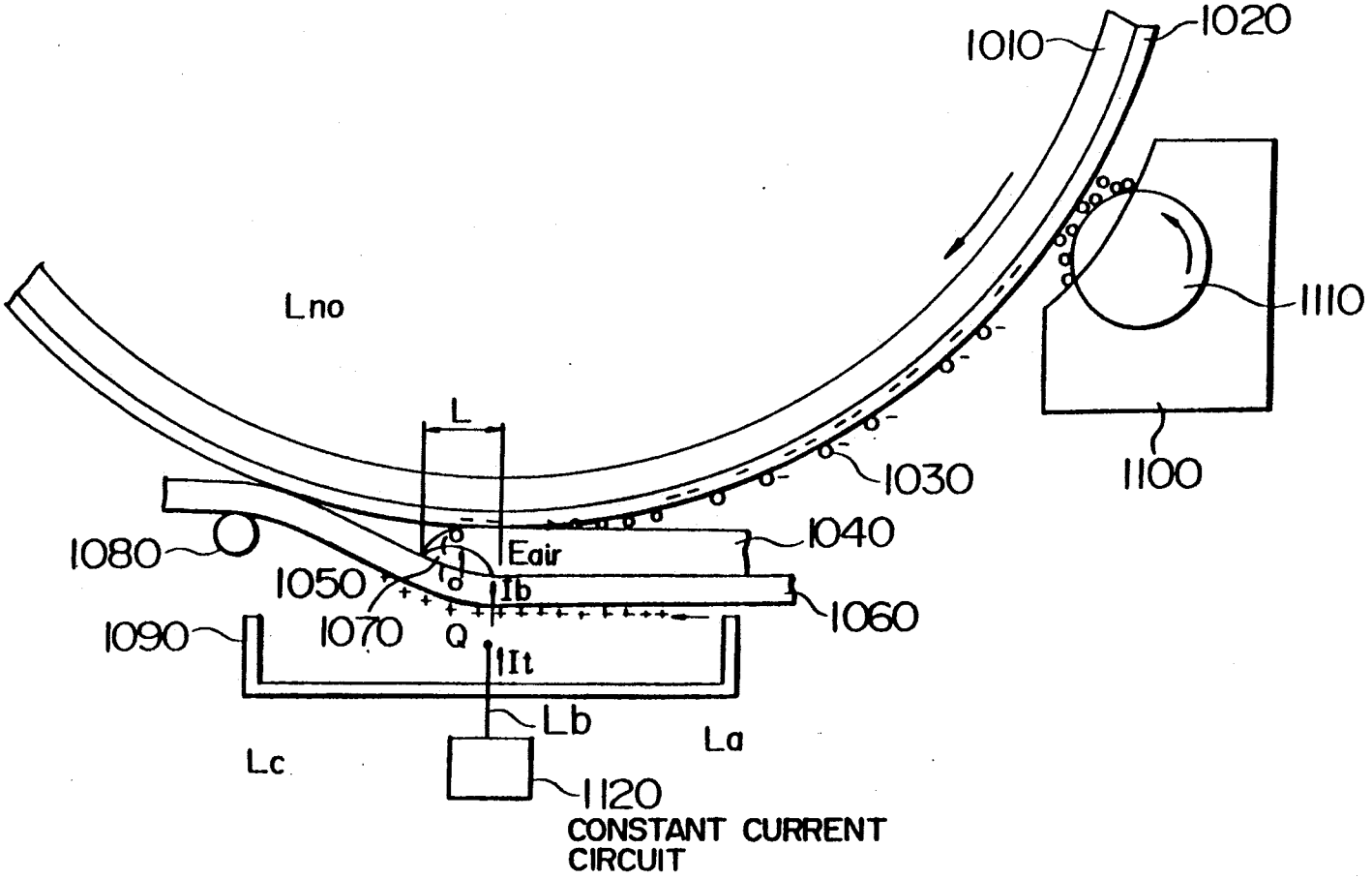
FIG. 37 is a diagram scehmatically showing a configuration for explaining the mechanism for causing a drum trap.

FIG. 37 is a diagram showing in enlarged form a trap region where the photosensitive member meets the recording paper transporter.

In FIG. 37, numeral 1010 designates a drum, numeral 1020 a photosensitive member or a photosensitive material on the surface of the drum 1010, numeral 1030 toner, numeral 1040 recording paper, numeral 1050 a burr at the forward end of the recording paper 1040, numeral 1060 a recording paper transporter, numeral 1070 a gap, numeral 1080 a pressure roller, 1090 a corona charger, numeral 1100 a developer, numeral 1110 a developing roller, and numeral 1120 a constant-current source.

Due to the presence of the burr 1050 at the forward end of the recording paper 1040, the gap 1070 having the width L of about 0.1 to 10.0 mm is formed between the burr 1050 and the recording paper transporter 1060. The forward end of the recording paper 1040 including the burr 1050 is left blank and is not affected by transfer. The corona wire of the corona charger 1090 is supplied with a current It from the constant-current source 1120. Approximately 10 to 30% of this current flows into the recording paper transporter 1060 as a charge current Ib, and causes the accumulation of a positive charge amount Q (coulomb/cm2). In the process, positive and negative charges are generated in the gap 1070 based on the charge amount Q, thereby forming an electric field $E_{air}$.

Assume that the recording paper 1040 having the burr 1050 at the forward end thereof is transported by the recording paper transporter 1060 and reaches the nip region. The positive charge accumulated on the back of the recording paper transporter 1060 is accumulated by the corona charger 1090. This positive charger causes the toner 1030 having a negative charge deposited on the surface of the photosensitive member 1020 to be adsorbed onto the surface of the recording paper 1040, with the result that the visible image formed on the surface of the photosensitive member 1020 is transferred onto the recording paper 1040.

Figure 38A:
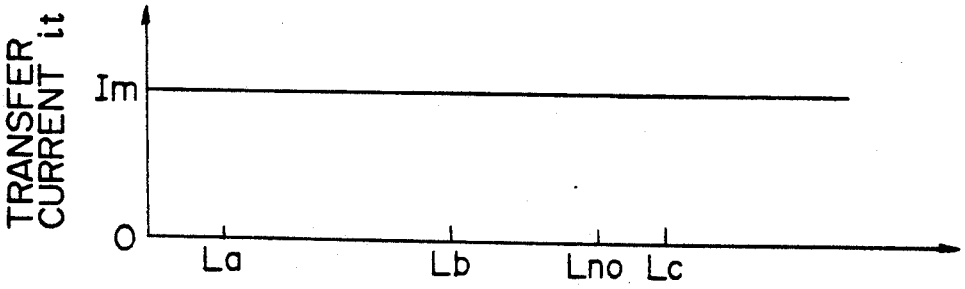
FIGS. 38A and 38B are characteristic graphs showing the relationship between the position of the forward end of recording paper, charge amount and the gap charge.

In this case, as shown in FIG. 38A, the corona charger 1090 is supplied with a transfer current Im. When the recording paper 1040 enters the corona charger 1090, the charge Q accumulated on the recording paper transporter corresponding to the portion of the forward end burr 1050 is increased progressively until the arrival of the outlet end Lc of the corona charger 1090, as shown by the curve 1 of FIG. 38B. With the arrival of the portion of the burr 1050 at the position Lp between the inlet end and La and the nip outlet Lno, the electric field $E_{air}$ of the gap 1070 reaches a discharge start electric field Eb (30 kv/cm in atmospheric pressure), as shown by the curve 2 thereby to generate discharge in the gap 1070. Upon occurrence of this discharge, both positive and negative charges are generated. The positive charge is attracted toward the negative charge on the photosensitive member 1020 and injected into the recording paper 1040, while the negative charge is injected into the recording paper transporter 1060. As a result, an electrostatic adsorption force is generated between the recording paper 1040 and the photosensitive member 1020, with the result that the recording paper 1040 is wound on the photosensitive member 1020.

Figure 38B:
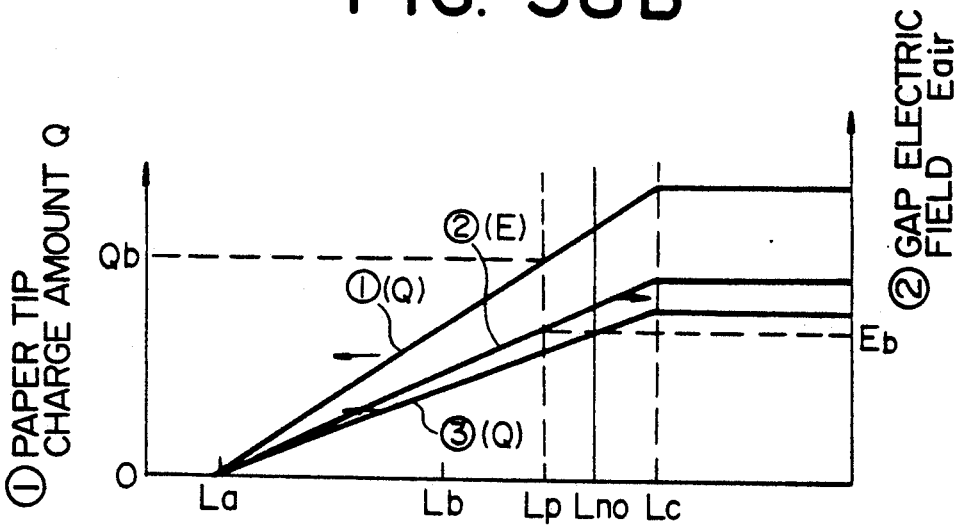

As shown by the curve 3 of FIG. 38B, even when the charge Q begins to be accumulated on the recording paper transporter corresponding to the portion of the burr 1050 before reaching the inlet end La of the corona charger 1090 and progressively increases in amount during the relocation of the burr 1050 from the inlet end La to the outlet end Lc of the corona charge 1090, no discharge occurs in the gap and therefore drum trap is not caused, to the extent that the amount of the charge at the nip outlet Lno is such that the electric field $E_{air}$ of the gap 1070 does not exceed the amount Qb of the charge corresponding to the discharge start electric field Eb of the air.

Now, another embodiment of the present invention will be explained with reference to the accompanying drawings. Before explaining such an embodiment, a general configuration of an electrophotographic recording apparatus to which the present invention is applicable will be described. An example of the configuration of such an apparatus is shown in FIG. 39.

Figure 39:
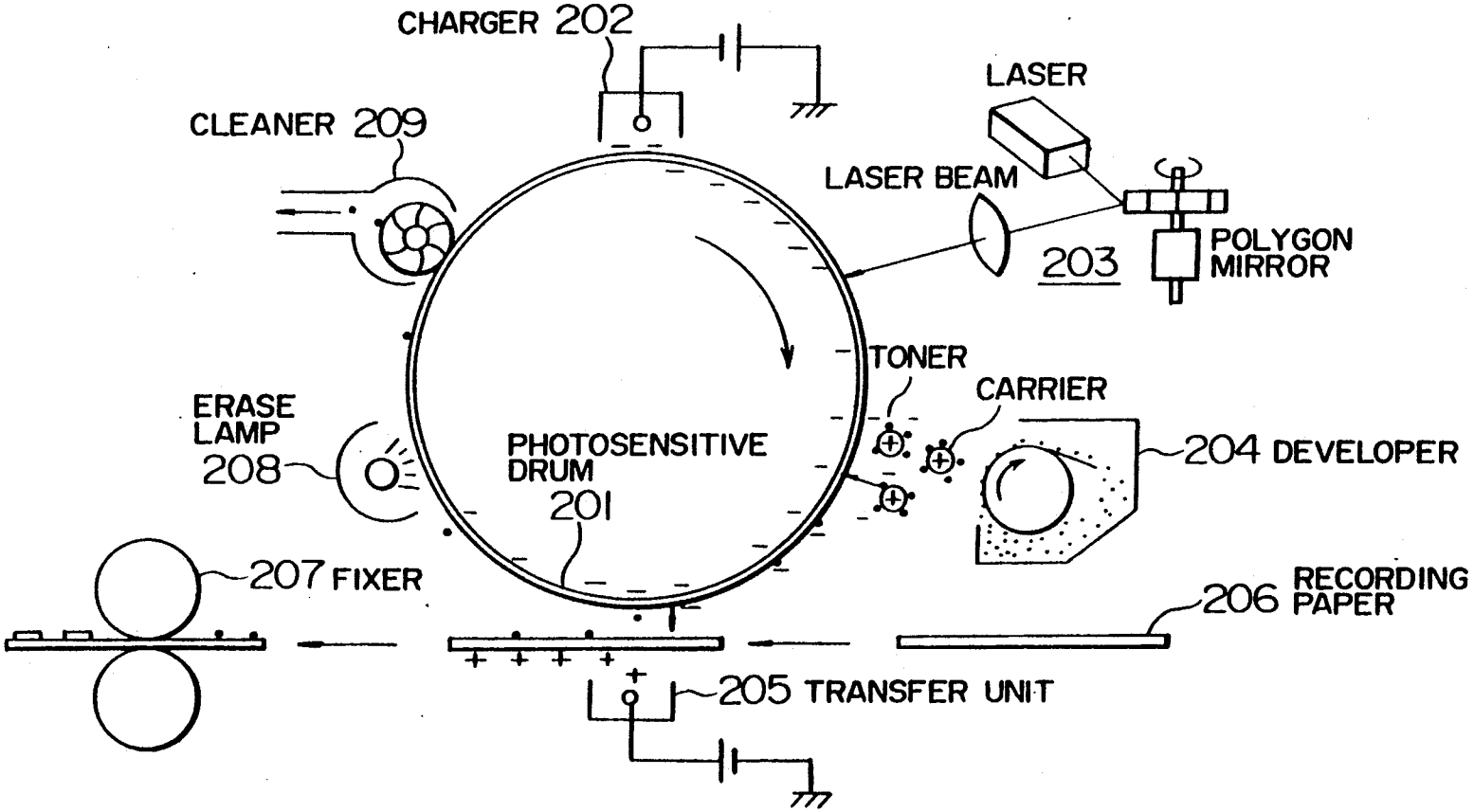
FIG. 39 is a diagram schematically showing a general configuration of an electrophotographic recording apparatus.

In FIG. 39, an electrophotographic recording apparatus comprises a photosensitive drum 201, a charger 202, an exposure device 203, a developer 204, a transfer unit 205, recording paper 206, a fixer 207, an erase lamp 208 and a cleaner 209.

The electrophotographic recording apparatus under consideration is operated generally as described below.

The photosensitive drum 201 is rotated at a predetermined speed by a drive unit not shown, and has the surface thereof initially charged uniformly to a negative state by the charger 202. As the next step, the same surface is exposed to light by the exposure device 203 including a laser light emitter and a polygonal mirror thereby to form an electrostatic latent image. With negatively-charged toner attached to the developer 204, the electrostatic latent image is developed, and a visible image corresponding to the electrostatic latent image is formed on the same surface. This visible image is then transferred to a nip region having the transfer unit 205. In the process, the recording paper 206 transported on a recording paper transporter (not shown) arrives at the the nip region. Since the recording paper 206 is charged by positive charges at the transfer unit 205 together with the recording paper transporter, the toner attaches on the recording paper at the nip region to accomplish the transfer of the visible image. In the following steps, toner is fixed on the recording paper 206 with the visible image transferred thereto by the fixer 207, thereby performing a predetermined recording operation. After transfer, the toner remaining on the surface of the photosensitive drum 201 is removed by the erase lamp 208 and the cleaner 209 in preparation for another repetition of the cycle mentioned above.

Figure 28:
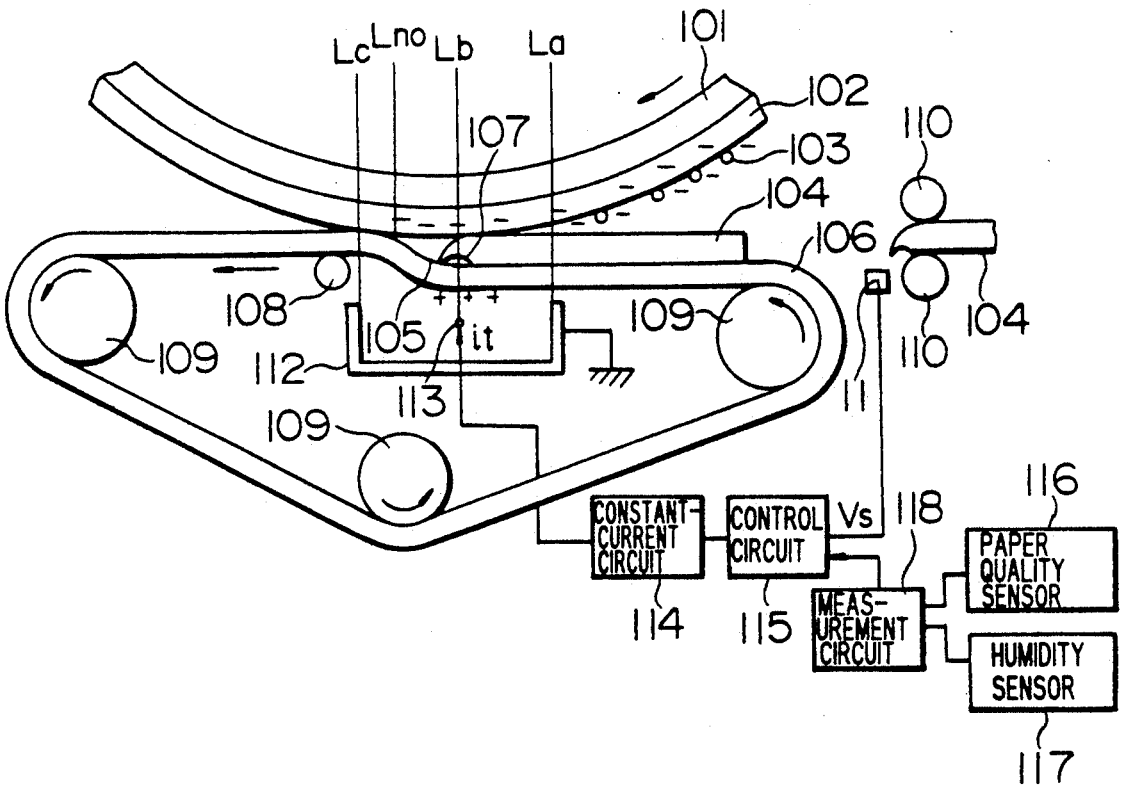
FIG. 28 is a diagram schematically showing another example of the image-forming apparatus according to the present invention.

An embodiment of the present invention will be described. First, FIG. 28 shows a configuration of the essential parts of an electrophotographic recording apparatus according to a seventh embodiment of the present invention. The peripheral portion of the transfer unit 205 shown in FIG. 39 is specifically illustrated.

In FIG. 28, numeral 101 designates a drum, numeral 102 a photosensitive member, numeral 103 toner, numeral 104 recording paper, numeral 105 a burr at the forward end of the recording paper, numeral 106 a recording paper transporter, numeral 107 a gap, numeral 108 a pressure roller, numeral 109 a drive roller, numeral 110 a resist roller, numeral 111 a paper position sensor, numeral 112 a corona charger, numeral 113 a corona wire, numeral 114 a constant-current source, numeral 115 a control circuit, numeral 116 a paper quality sensor, numeral 117 a humidity sensor, and numeral 118 a measuring circuit.

The recording paper transporter 106 is driven in the direction of the arrow in FIG. 28 by the drive roller 109 thereby to feed the recording paper 104 supplied through the resist roller 110. The corona wire 113 of the corona charger 112 receives a current It from the constant-current source 114 for generating a charge in the recording paper transporter 106 as shown. The paper position sensor 111 arranged in the vicinity of the resist roller 110 detects the forward end or the like of the recording paper 104 supplied from the resist roller 110, and applies a detection output Vs thus obtained to the control circuit. The paper quality sensor 116 detects the type such as thickness, whether high quality or recycled state and the like information on the recording paper 104, and the humidity sensor 117 the humidity of the ambience. These detection outputs are applied through the measuring circuit 118 to the control circuit. According to the present embodiment, the recording paper transporter 106 is of a three-layer structure about 650 μm thick with a fluoride film formed on the two sides of a urethane rubber belt 500 μm thick.

The operation of the present embodiment will be described below.

Figure 29:
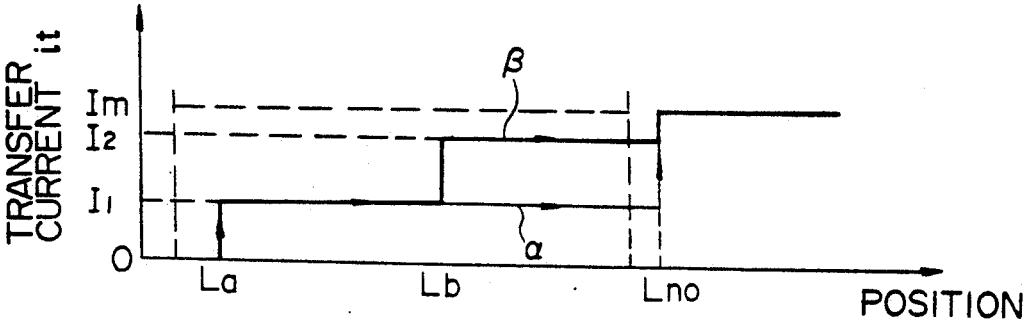
FIG. 29 is a diagram for explaining the chronological change of transfer current of the corona charger.

Now, when the recording paper 104 is supplied through the resist roller 110 and the forward end thereof is detected by the paper position sensor 111, a detection signal Vs is applied to the control circuit 115. The control circuit 115 sets the timing and value of the current It applied to the corona wire 113. Upon arrival of the forward end of the recording paper 104 at the inlet end La of the corona charger 112, the control circuit 115 generates the current It having a magnitude of I1 as shown in FIG. 29, thereby starting the operation for applying a forward end supply charge Q1 to the recording paper transporter 106 as described below. When the forward end of the recording paper 104 is transported to the outlet Lno of the nip region, the control circuit 115 generates the current It having a magnitude of Im as shown in FIG. 29, and the operation shifts from the process of supplying the forward end supply charge Q1 to the process of normal transfer.

The time Tc during which the forward end of the recording paper 104 receives the charge from the corona charger 112 is given as Tc−(Lno−La)/Ub where Ub is the feed rate of the recording paper transporter 106. Assuming that the average value of current flowing into the recording paper transporter 106 of the total current It of $I_1$ in magnitude generated by the control circuit 115 is I1 v, the charge amount Q1 applied to the recording paper transporter 106 corresponding to the forward end of the recording paper 104 is expressed as Q1=Tc×I1 v. If the charge amount Q1 is selected as a value smaller than the charge amount Qb shown in FIG. 36, therefore, the recording paper 104 is not wound on the photosensitive member 102, thereby preventing the drum trap phenomenon. The transfer characteristic is determined by the current flowing into the recording transporter.

In the example described above, the current It supplied to the corona charger 112 is varied in two stages of $I_1$ and Im. As an alternative method, as shown in FIG. 29, the control circuit 115 is adapted to generate the current It of $I_2$ in value larger than It so far supplied when the forward end of the recording paper 104 is transported to the intermediate point of the corona charger 112, and generates a current It having a magnitude of Im as in the above-mentioned case when the forward end of the recording paper 104 is fed to the outlet portion Lno of the nip region. The current may be thus changed in three stages.

Assume that the average value of the current flowing into the recording paper transporter 106 of the total current It having a magnitude of I2 generated by the control circuit 115 is $I_{2v}$. The initial charge amount Q12 applied to the recording paper transporter 106 corresponding to the forward end of the recording paper 104 is given as $$\frac{1}{Ub}\{I_{1v}(Lb - La) + I_{2v}(LNO - Lb)\}$$

Figure 36:
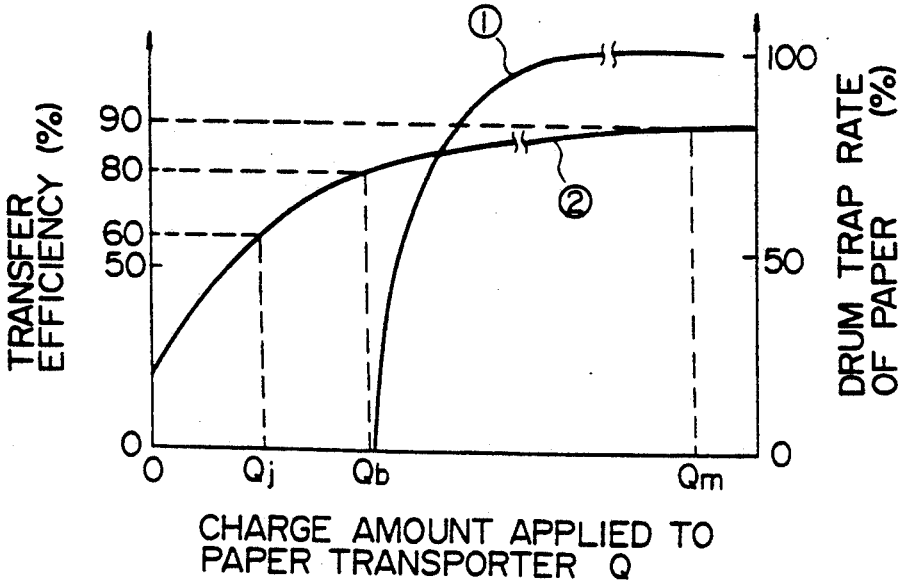
FIG. 36 is a characteristic graph showing the relationship between the charge amount, transfer efficiency and drum trap rate.

If the initial charge amount Q12 is selected to be smaller than the charge amount Qb shown in FIG. 36, the recording paper 104 is not wound on the sensitive member 102, thereby preventing the drum trap phenomenon.

In view of the fact that the drum trap phenomenon depends on the type of the recording paper 104, environment, especially humidity, the detection output from the paper quality sensor 116 or the humidity sensor 117 is appropriately processed at the measuring circuit 118, and the resulting signal is supplied to the control circuit 115 thereby to control the magnitude of the current It supplied to the corona charger 112 when the type of the recording paper 104 is changed or the humidity undergoes a considerable change.

In FIG. 29, the current It of a magnitude $I_1$ is supplied for the first time to the corona charger 112 at the time point when the forward end of the recording paper 104 reaches the inlet end La of the corona charger 112. Nevertheless, in the case where it is difficult to detect the time point when the forward end of the recording paper 104 reaches the inlet end La, the current It having a magnitude $I_1$ may be supplied before the forward end of the recording paper 104 reaches the inlet end La.

Figure 30:
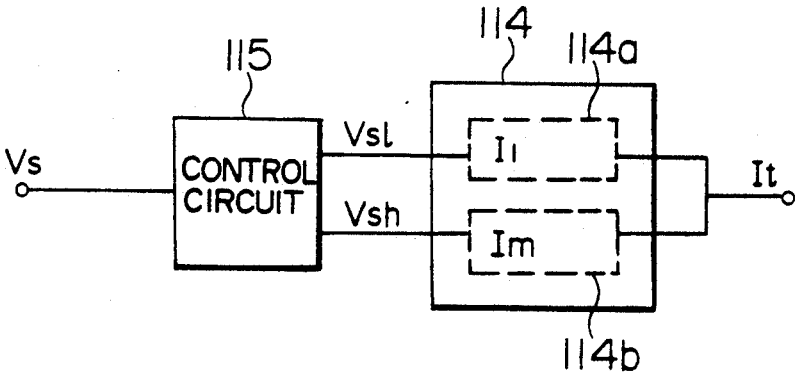
FIG. 30 is a block diagram showing the internal strcuture of a constant-current source.

FIG. 30 is a block diagram showing a detailed configuration of the constant-current source 114 and the control circuit 115 used in the embodiment shown in FIG. 28.

In FIG. 30, numeral 114*a* designates a low current source, and numeral 114*b* a high current source. The remaining component parts identical to those in FIG. 28 are designated by the same reference numerals respectively as in FIG. 28.

The constant-current source 114 includes the low current source 114*a* for generating a small current and a high current source 114*b* for generating a large current. The low current source 114*a* and the high current source 114*b* are supplied with control signals Vsl and Vsh respectively from the control circuit 115.

The operation of the constant current source 114 will be explained with reference to FIGS. 31A and 31B, in which each signal is indicated by negative logic.

Figures 31A, 31B:
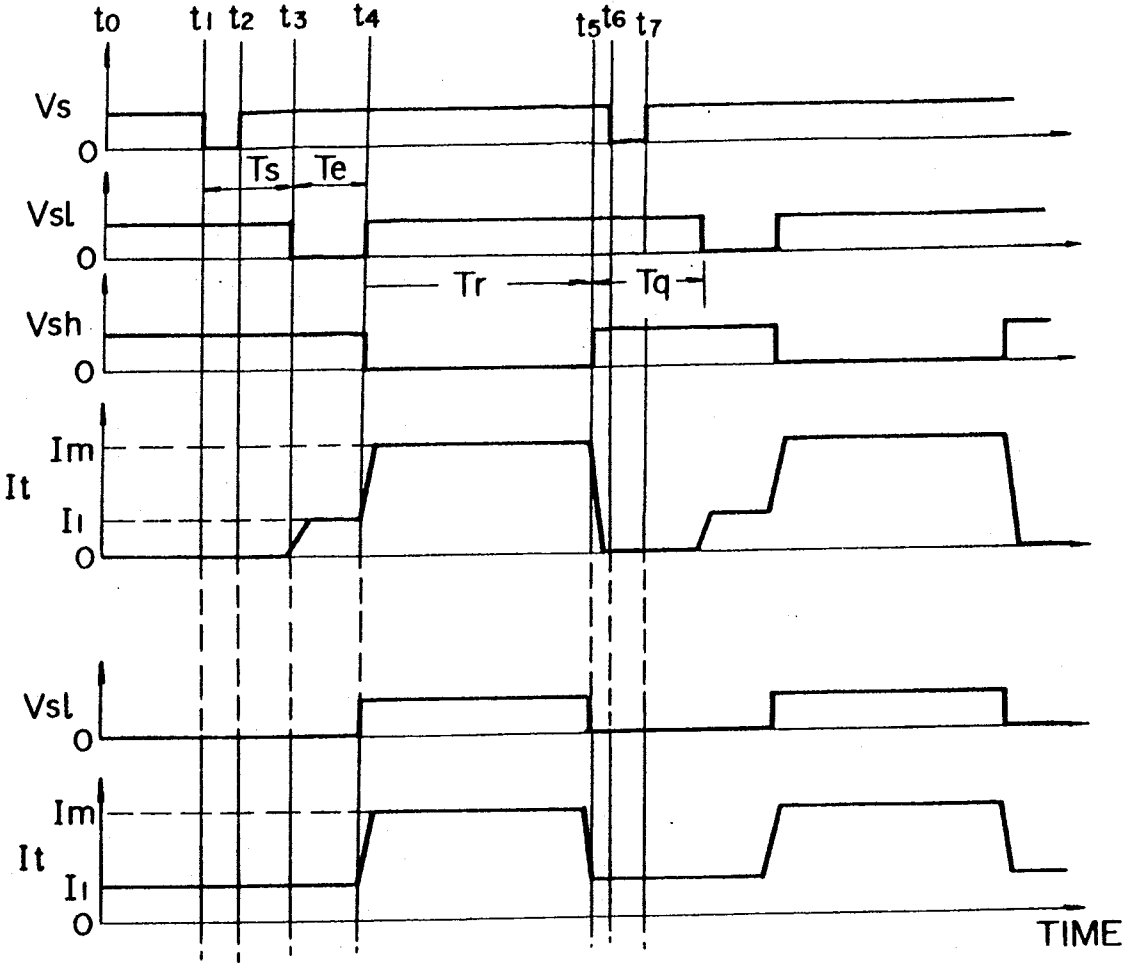
FIGS. 31A and 31B are diagrams for explaining the chronological change of transfer current produced by a constant-current source.

First, in FIG. 31A, when the paper position sensor 111 detects the forward end of the recording paper 104 at a time point $t_0$, a detection signal Vs having a high level from $t_0$ to $t_1$ is generated. When the detection signal Vs decreases to low level, the control circuit 115 generates a control signal Vsl of low level between $t_3$ and $t_4$ after the lapse of the time Ts. The low current source 114*a* generates a current It of small value I1 during the application of the control signal Vsl. Then, at time point $t_4$, the control circuit 115 generates a control signal Vsh kept at low level from $t_4$ to $t_5$, so that the current It of a large value Im is generated by the high current source 114*b* during the application of the control signal Vsh. At the following time point $t_6$, the paper position sensor 111 detects the forward end of the recording paper 104 again, and a detection signal Vs kept at low level from $t_6$ to $t_7$ is generated thereby to repeat the above-mentioned cycle of operation. In FIG. 30, character Ts designates the time before the forward end of the recording paper 104 reaches the inlet end La of the corona charger 112 after being detected by the paper position sensor 111, character Te the time before the forward end of the recording paper 104 reaches the outlet end Lno of the nip region from the inlet end La of the corona charger 112, character Tr the time during which a transfer current of a large value Im flows, and character Tq the time interval between the arrival of one recoding paper 104 and the next recording paper 104.

The current It generated by the constant-current source 114 assumes a small value $I_1$ between time $t_3$ and $t_4$ and a large value Im between $t_4$ and $t_5$ thereby to effect the prevention of the drum trap phenomenon and normal transfer as mentioned above.

FIG. 31B shows an example in which a current It of small value $I_1$ is supplied even between one recording paper 104 and the next recording paper 104. In this case, the timing of the control signal Vsh generated by the control circuit 115 is the same as Vsl of FIG. 31A, but the control signal Vsl assumes a voltage waveform low in level between time $t_4$ and $t_5$ as shown in FIG. 31B.

As a result, the current It generated by the constant-current source 114 assumes a large value Im between $t_4$ and $t_5$ and a small value $I_1$ during the remaining time, thereby preventing the drum trap phenomenon and normal transfer. In this example, as compared with the above-mentioned example, the rise time of the current It of the low current source 114*a* is not required to be taken into consideration, although the life of the recording paper transporter 106 which is always exposed to corona is somewhat shortened.

Figure 33:
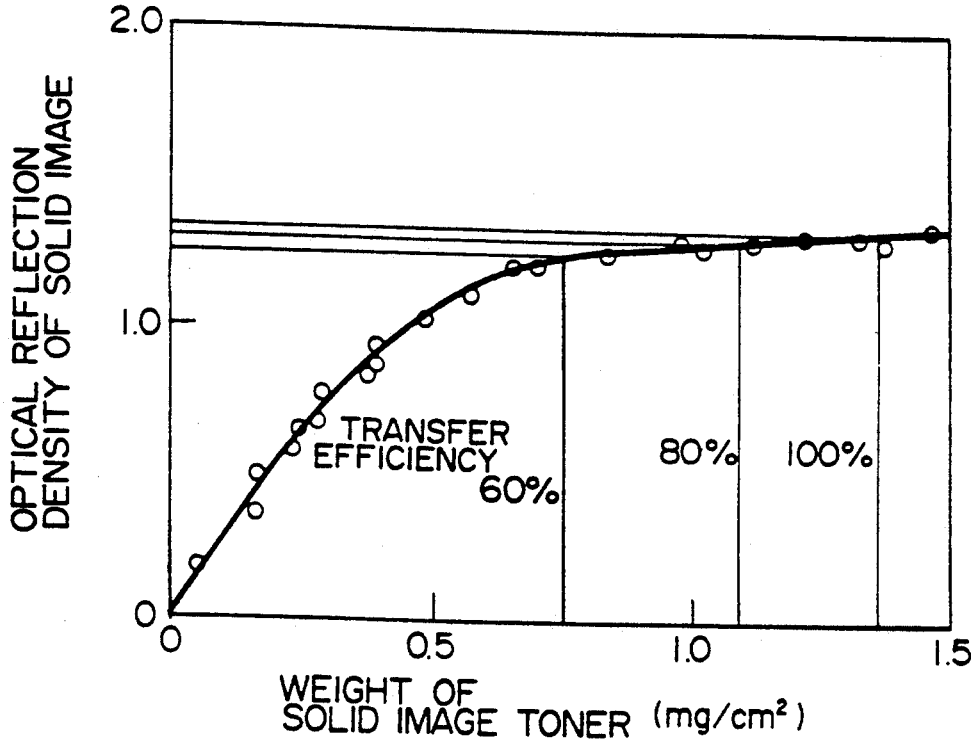
FIG. 33 is a graph showing the relationship between the toner weight and the optical reflection density.

In actual operation, assume that the feed rate of the recording paper transporter 106 is 10 ips, the width of the corona charger 112 is 20 mm, the width of the nip region (which is equal to $(Lno-Lb)\times 2$) is 10 mm, the environmental condition is 20° C. and 20% Rh, the current supplied is It as shown in FIG. 4A, the time Tc is 69 ms, the current $I_1$ supplied to the corona charger 112 is 25 to 100 μA, and Im is 300 μA. The current flowing into the forward end of the recording paper 104 is 5 to 20 μA, the current flowing into other than the forward end of the recording paper 104 is about 50 μA, and the transfer efficiency of the region within about 10 mm of the forward end of the recording paper 104 is 60 to 80%. FIG. 33 shows the optical reflection density of an image with the transfer efficiency as a parameter. This diagram shows that the optical reflection density tends to be substantially saturated for the transfer efficiency of 60% or more in spite of an increase in toner weight of the paper. According to the present invention, therefore, the recording of a high image quality is made possible. At the same time, it was confirmed that the recording paper 104 is prevented from being wound on the photosensitive member 102.

As a result of starting the energization of the corona charger 112 (I1=approx. 70 μA) from the time point when the forward end of the recording paper 104 reaches the central point (where the corona wire 113 exists) Lb and increasing the current supplied to the corona charger 112 (Im=approx. 300 μA) from the time point when the forward end of the recording paper 104 reaches the outlet Lno of the nip region, it was found that the transfer efficiency in the region up to about 3 mm from the forward end of the recording paper 104 is 60 to 80% and that in the other regions about 80% or more, thereby posing no special problem. Further, it was confirmed that no winding of the recording paper 104 on the photosensitive member 102 occurs.

After changing the environmental conditions to 20° C. and 40% RH with the small value $I_1$ changed to 200 μA and the large value Im to 300 μA, it was found that the recording paper 104 is not wound on the photosensitive member 102 and that a transfer efficiency of about 80% or more is obtained over the whole of the recording paper 104.

Figure 32:
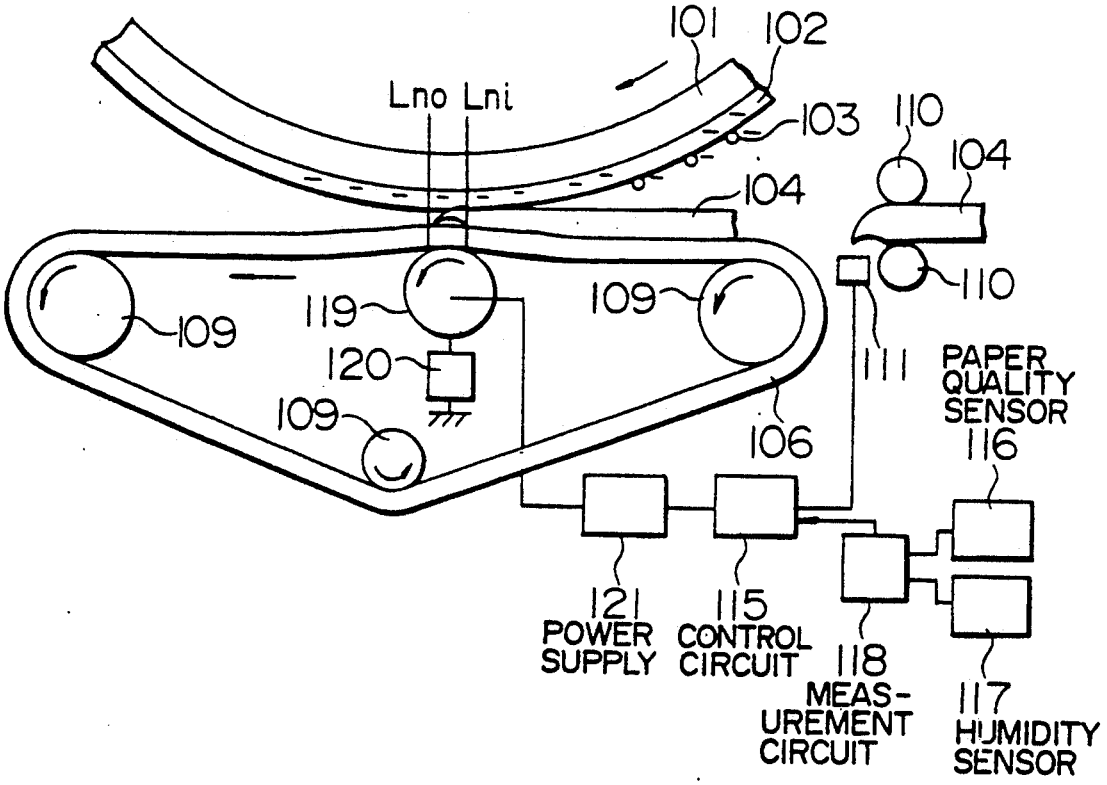
FIG. 32 is a diagram schematically showing a configuration of another example of the image-forming apparatus according to the present invention.

FIG. 32 is a diagram showing a configuration of an electrophotographic recording apparatus according to an eighth embodiment of the present invention.

In FIG. 32, numeral 119 designates a conductive bias roller for pressing the recording paper transporter 106 against the photosensitive member 102, numeral 120 pressure application means, and numeral 121 a voltage source. The other component parts identical to those in FIG. 28 are designated by the same reference numerals respectively.

The conductive bias roller 119 is made of a metal roller with the surface thereof formed with or without a low-resistance film. The roller 119, while rotating by the function of the pressure application means 120, presses the recording paper transporter 106 against the photosensitive member 102, while at the same time applying a voltage to the recording paper transporter 106 by the voltage supplied from the voltage source 121.

The operation of the present embodiment is such that a voltage is applied through the conductive bias roller 119 to the recording paper transporter 106, and positive charge is generated in the recording paper transporter 106 by the particular voltage. The present embodiment is substantially identical to the seventh embodiment except that means for generating the charge is different from that included in the seventh embodiment.

Figure 34:
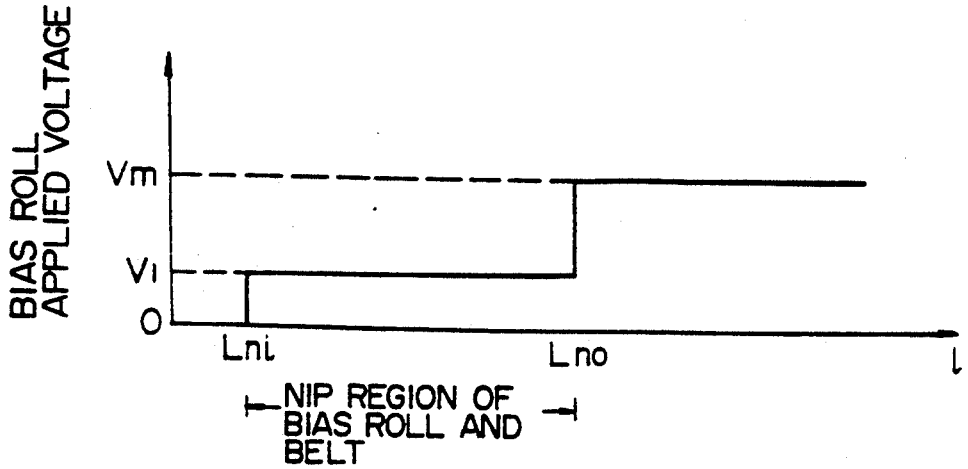
FIG. 34 is a diagram for explaining the chronological change of the applied voltage of a bias roller.

The means for applying a voltage to the recording paper transporter 106 will be explained with reference to a chronological change of the voltage applied to the bias roller 119 shown in FIG. 34.

When the recording paper 104 is detected by the paper position sensor 111 and the forward end thereof reaches the inlet point Lni of the nip region, the control circuit 115 controls the voltage source 121 and supplies a voltage of small value $V_1$ to the bias roller 119. Further, with the arrival of the forward end at the outlet point Lno of the nip region, the control circuit 115 supplies the bias roller 119 with a voltage of large value Vm required for normal transfer.

The voltage $V_1$ is selected in such a small value that no discharge is caused in a gap 107 which may be formed between the forward end of the recording paper 104 and the recording paper transporter 106 due to a burr 105, if any, at the forward end of the recording paper 104 even when the voltage of small value $V_1$ is applied to the recording paper transporter 106. In other words, the voltage of small value $V_1$ is such that the charge amount Q generated in the recording paper transporter 106 by the supply of the small value $V_1$ is smaller than the above-mentioned charge amount Qb and that the charge amount Q generated by the small amount $V_1$ secures a transfer efficiency of at least 60%.

As a result, the present embodiment also prevents the recording paper 104 from being wound on the photosensitive member 102 and the transfer image at the forward end of the recording paper from being deteriorated at the same time.

Figure 35:
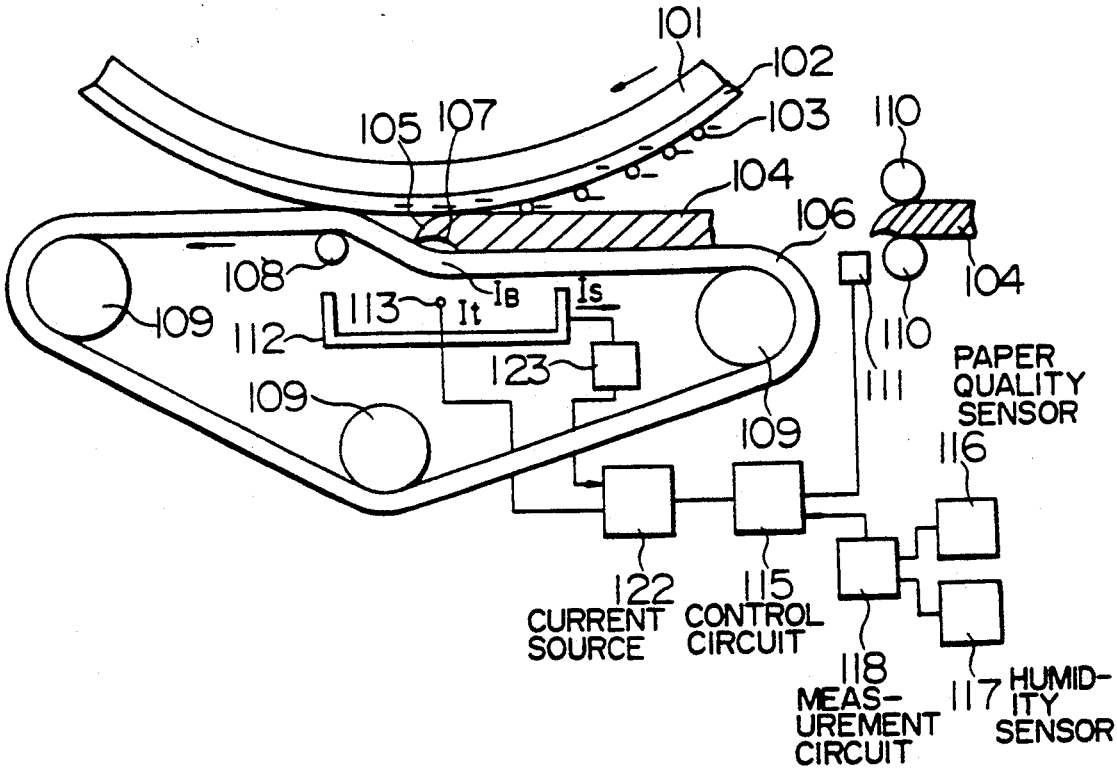
FIG. 35 is a diagram schematically showing a configuration of another embodiment of the image-forming apparatus according to the present invention.

FIG. 35 is a diagram showing a configuration of an electrophotographic recording apparatus according to a ninth embodiment of the present invention.

In FIG. 35, numeral 122 designates a current source, numeral 123 a shield flow-in current detector circuit. The remaining component parts are designated by the same reference numerals as the corresponding ones respectively in FIG. 28.

The shield flow-in current detector circuit 123 is for detecting a current Is flowing into the shield of the cornoa charger 112 as part of the current It flowing in the corona wire 113 of the corona charger 112. The current source 122 is adapted to change the output current value It on the basis of the result of detection of the shield flow-in current detector circuit 123.

More specifically, the current It supplied to the corona wire 113 of the corona charger 112 from the current source 122 is partly applied as a flow-in current Ib to the recording paper transporter 106 and partly as a shield current Is to the shield of the corona charger 112. In the process, even when the current It is kept constant, the magnitude of the shield current Is changes depending on the environmental conditions or the like and therefore the flow-in current Ib cannot be maintained constant. According to the present embodiment, however, the value of the shield current Is is detected at the shield flow-in current detector circuit 123 in such a manner that when the value of the shield current Is undergoes a change, a signal commensurate with the polarity and amount of the change is fed back to the current source 122. The current It is thus rendered variable with the amount of feedback, with the result that the flow-in current Ib is maintained at a constant level.

The other operations are identical to those of the seventh embodiment and will not be described any further.

According to the present embodiment, the current flowing into the recording paper transporter 106 directly related to the amount of charge applied to the recording paper transporter 106 is appropriately controlled. Therefore, a control of higher accuracy is possible than when the transfer current It of the corona charger 112 is controlled as in the seventh embodiment.

Although the above-mentioned embodiments use a drum-shaped photosensitive member 102, the present invention is not limited to a drum-shaped photosensitive member 102 but may be applied with equal effect to an apparatus with a photosensitive sheet wound on the drum or a belt-shaped photosensitive member 102 with a comparatively large radius of curvature.

According to the present invention, the transfer member transport means is equipped with a pressure guide as a winding-prevention means with or without an additional guide. Therefore, at least a part of the forward end of the transfer member can be pressed against the transfer member transport means by the guide, thereby preventing the transfer member from being wound on an image carrier (in what is called a drum trap).

According to another aspect of the present invention, means is included for removing an image-forming medium (toner) accumulated on that part of the transfer member transport means where the transfer member is transported in lesser frequency, and therefore the image-forming medium (toner) accumulated on the arrangement of the winding-prevention means, or especially, the additional guide, can be removed effectively, thereby preventing the forward end of the transfer member from being fouled at the time of copying operation.

FIG. 36 is a graph representing the relationship between the charge amount Q applied to the recording paper transporter 1060, the transfer efficiency (%) (curve 2) and the rate of drum trap occurrence (%) (curve 1) of the recording paper 1040. This relates to the seventh, eighth, and ninth embodiments of the present invention.

As shown by curve 1 of the graph, if the charge amount Q applied to the recording paper transporter 1060 is less than Qb, the rate of drum trap occurrence is zero. When the charge Q exceeds Qb, on the other hand, the rate of drum trap occurrence suddenly increases. It will be seen from the curve 2 of the graph that when charge Q applied to the recording paper transporter 1060 is smaller than Qb, the transfer efficiency is reduced as compared when the transfer charge Q is applied. If the charge Qj shown in the drawing is selected as the charge Q, for example, the transfer efficiency of about 60% is attained. By the way, when the charge Q is not applied to the recording paper transporter 1060 at all, the transfer efficiency is less than 20% and the concentration of the transfer image is so low that an image becomes irregular and is deteriorated unavoidably.

According to the present invention, the recording paper transporter 1060 associated with the forward end of the recording paper is supplied with a charge or voltage of the same polarity as the transfer charge or voltage, though not sufficient for transfer. In addition, the charge Qj is consequently applied to the recording paper transporter 1060. As a result, a transfer electric field is developed between the surface of the photosensitive member 1020 and the recording paper transporter 1060, so that the visible image on the surface of the photosensitive member 1020 is transferred even at the forward end of the recording paper 1040. Further, a clear transfer is possible as in the prior art since a transfer charge or voltage sufficient for transfer is applied also at other than the forward end of the recording paper 1040.

The charge amount Qj should be selected at such a value that the transfer efficiency is more than 60%, or more preferably, about 60 to 70%, in which case image deterioration is substantially avoided, thereby posing no practical problem.

According to still another aspect of the present invention, the part of the recording paper transporter corresponding to the forward end of the recording paper is supplied with a charge Qj smaller than and having the same polarity as the transfer charge Qm. Regardless of a burr which may be formed at the forward end of the recording paper, the type of the recording paper or the environmental conditions, therefore, the winding of the recording paper on the photosensitive member, i.e., the drum trap phenomenon, is effectively prevented.

Also, the charge amount Qj, though insufficient for normal transfer, is of the same polarity as the transfer charge. A transfer electric field, therefore, functions effectively between the surface of the photosensitive member and the recording paper transporter, thereby making it possible to transfer a visible image from the surface of the photosensitive member even at the forward end of the recording paper.

Since a transfer charge sufficient for transfer is applied to other parts than the forward end of the recording paper, a clear transfer is possible as in the conventional apparatuses.

As explained above, according to the present invention, neither the transfer image at the forward end of the recording paper is deteriorated, nor is the recording paper wound on the photosensitive member. An electro-photographic recording apparatus free of what is called the phenomenon of drum trap is thus realized with a simple configuration.

What is claimed is:

1. An image-forming apparatus comprising:

an image carrier;

means for forming a visible image on said image carrier in accordance with projected image information;

transfer member transport means for transporting a transfer member;

transfer means for transferring said visible image to said transfer member at a transfer point where said image carrier is in contact with the transfer member transport means;

means for controlling a discharge in a gap formed between a forward end of said transfer member and said transfer member transport means; and means for pressing said transfer member to said transfer member transport means to remove an air gap formed between the forward end of said transfer member and said transfer member transport means before said forward end of said transfer member reaches a nip region.

2. An image-forming apparatus comprising:

an image carrier;

means for forming a visible image on said image carrier in accordance with projected image formation;

transfer member transport means for transporting a transfer member;

transfer means for transferring said visible image to said transfer member at a transfer point where said image carrier is in contact with the transfer member transport means; and winding prevention means for preventing said transfer member from being transported on said image carrier after said transfer, said winding prevention means including a pressure guide in contact with said transfer member transport means upstream of said transfer point and arranged along a width of said transfer member transport means, said pressure guide being made of a tabular member arranged at a sharp angle to a plane of transportion and the direction of progress of said transfer member transport means.

3. The image-forming apparatus of claim 2, wherein said tabular member comprises a conductive metal film and a laminated film of high polymer material, and said conductive metal film is conductively grounded.

4. An image-forming apparatus comprising:

an image carrier;

means for forming a visible image on said image carrier in accordance with projected image information; transfer member transport means for transporting a transfer member;

transfer means for transferring said visible image to said transfer member at a transfer point where said image carrier is in contact with said transfer member transport means; and winding preventing means for preventing said transfer member from being transported on said image carrier after said transfer, wherein said winding prevention means includes, a pressure guide arranged in contact with and along a width of said transfer member transport means, and an additional guide arranged other than along the width of said transfer member transport means.

5. The image-forming apparatus of claim 4, wherein said additional guide comprises a fixed additional guide not in contact with said transfer member transport means.

6. The image-forming apparatus of claim 4, wherein said additional guide comprises a selective additional guide switchable between a first state of contact with said transfer member transport means and a second state of non-contact with said transfer member transport means.

7. The image-forming apparatus of claim 6, wherein said selective additional guide is divided into a plurality of portions along a width of said transfer member transport means.

8. The image-forming apparatus of claim 4, wherein said additional guide includes a single guide selectively movable along the width of said transfer member transport means.

9. The image-forming apparatus of claim 4, wherein each of said pressure guide and said additional guide are configured to be switchable between a first state of contact with said transfer member transport means and a second state of non-contact with said transfer member transport means.

10. The image-forming apparatus of claim 7, wherein said selective additional guide is divided into a plurality of portions along the width of said transfer member transport means, said portions being controlled to be switchable between a first state of contact with said transfer member transport means and a second state of non-contact with said transfer member transport means in accordance with a size of the transfer member in use.

11. The image-forming apparatus of claim 6, wherein the operation of switching between contact and non-contact states of said selective additional guide is performed by changing the angle formed by said selective additional guide to the direction of progress and the plane of transportion of said transfer member transport means.

12. The image-forming apparatus of claim 6, wherein the operation of switching between contact and non-contact states of said selective additional guide is performed by means of changing the planar position of said selective additional guide.

13. An image-forming apparatus comprising:

an image carrier;

means for forming a visible image on said image carrier in accordance with projected image information;

transfer member transport means for transporting a transfer member;

transfer means for transferring said visible image to said transfer member at a transfer point where said image carrier is in contact with the transfer member transport means; and winding preventing means for preventing said transfer member from being transported on said image carrier after said transfer, wherein said winding prevention means includes a pressure guide arranged along the width of said transfer member transport means, upstream of said transfer point, and in contact with said transfer member transported means by a plurality of protrusions angularly displaced from both a direction parallel to the direction of progress of said transfer member transport means and a direction perpendicular to said direction of progress.

14. The image-forming apparatus of claim 13, wherein said protrusions of said pressure guide are in contact with said transfer member transport means along a linear portion thereof.

15. The image-forming apparatus of claim 13, wherein said protrusions of said pressure guide along one half of the width of said transfer member transport means are arranged in a direction opposite to those along the other half thereof.

16. The image-forming apparatus of claim 13, wherein said protrusions of said pressure guide are in contact with the planar portion of said transfer member transport means, widening progressively in the direction of progress of said transfer member transport means.

17. The image-forming apparatus of claim 13, wherein said pressure guide is pressed against said transfer member transport means by a spring.

18. An image-forming apparatus comprising:

an image carrier means for forming a visible image on said image carrier in accordance with projected image information;

transfer member transport means for transporting a transfer member transfer means for transferring said visible image to said transfer member at a transfer point where said image carrier is in contact with said transfer member transport means;

winding prevention means for preventing said transfer member from being transported on said image carrier after said transfer, said winding prevention means including a pressure guide arranged in contact with and along a width of said transfer member transport means upstream of said transfer point; and protrusion means for temporarily protruding that part of said transfer member transport means which is in contact with said pressure guide.

19. An image-forming apparatus comprising:

an image carrier means for forming a visible image on said image carrier in accordance with projected image information;

transfer member transport means for transporting a transfer member transfer member for transferring said visible image to said transfer member at a transfer point where said image carrier is in contact with said transfer member transport means;

winding preventing means for preventing said transfer member from being transported while being carried on said image carrier after said transfer, said winding prevention means including a pressure guide arranged in contact with and along a width of said transfer member transport means upstream of said transfer point; and protrusion means for temporarily protruding that part of said transfer member transport means which is in contact with said pressure guide wherein said protrusion means comprises a roller with a protrusion formed on the back of said transfer member transport means.

20. An image-forming apparatus comprising:

an image carrier means for forming a visible image on said image carrier in accordance with projected image information;

transfer member transport means for transporting a transfer member transfer means for transferring said visible image to said transfer member at a transfer point where said image carrier is in contact with said transfer member transport means;

winding preventing means for preventing said transfer member from being transported while being carried on said image carrier after said transfer, said winding prevention means including a pressure guide arranged in contact with and along a width of said transfer member transport means upstream of said transfer point; and protrusion means for temporarily protruding that part of said transfer member transport means which is in contact with said pressure guide wherein said protrusion means comprises said transfer member transport means having a portion thereof including a protrusion.

21. An image-forming apparatus comprising:

an image carrier means for forming a visible image on said image carrier in accordance with projected image information;

transfer member transport means for transporting a transfer member transfer means for transferring said visible image to said transfer member at a transfer point where said image carrier is in contact with said transfer member transport means;

winding prevention means for preventing said transfer member from being transported while being carried on said image carrier after said transfer, said winding prevention means including a pressure guide arranged in contact with and along a width of said transfer member transport means upstream of said transfer point; and protrusion means for temporarily protruding that part of said transfer member transport means which is in contact with said pressure guide wherein said protrusion means is operated during a time period when said transfer member is not transported to said winding prevention means.

22. The image-forming apparatus of claim 21, wherein said protrusion means is operated immediately before said transfer member is supplied to said transfer member transporting means.

23. An electrophotographic recording apparatus comprising:

a photosensitive member moved at a predetermined speed;

an exposure device for exposing said photosensitive member to light;

a developer for developing an electrostatic latent image obtained by the exposure; a transfer unit for transferring a developed visible image to recording paper; and a recording paper transporter transporting the recording paper to said transfer unit;

wherein said transfer unit includes a charger for charging said recording paper transporter, said charger at least applying charge to said recording paper transporter when a forward end of said recording paper transported thereto reaches a nip region, the amount of forward end supply charge applied to a region corresponding to the forward end of said recording paper of said recording paper transporter being set smaller than an amount of charge applied to a region of said recording paper transporter corresponding to other than the forward end of the recording paper, and wherein an initial charge amount is selected in such a manner that the electric field generated in a gap between the recording paper at the forward end and said recording paper transporter by the charge is not greater than the discharge starting electric field of the air.

24. The electrophotographic recording apparatus of claim 23, wherein said forward end supply charge amount is selected at a value where a visible image of a photosensitive member is transferrable to the recording paper.

25. The electrophotographic recording apparatus of claim 23, wherein said charger is a corona charger capable of regulating the charge current amount.

26. The electrophotographic recording apparatus of claim 25, wherein said corona charger is energized in such a manner that a current supplied to the corona wire when the forward end of the recording paper is in a nip region is smaller than that when the forward end leaves the nip region.

27. The electrophotographic recording apparatus of claim 25, wherein said corona charger is controlled in such a manner that the current flowing into the recording paper transporter after the forward end has passed through the nip region is maintained at a constant value.

28. An electrophotographic recording apparatus comprising:

a photosensitive member moved at a predetermined speed;

an exposure device for exposing said photosensitive member to light;

a developer for developing an electrostatic latent image obtained by exposure;

a transfer unit for transferring a developed visible image to the recording paper; and a recording paper transporter transporting the recording paper to said transfer unit;

wherein said transfer unit includes a conductive bias roller for pressing a recording paper transporter against said photosensitive member, said bias roller applying a voltage to said recording paper transporter when an incoming forward end of said recording paper reaches a nip region, while the forward end voltage applied to the recording paper transporter corresponding to the forward end of said recording paper is set to a value smaller than the voltage applied to the recording paper transporter corresponding to other than the forward end of the recording paper, and said forward end voltage is selected at such a value that the electric field generated by said voltage in a gap between the recording paper at the forward end and said recording paper transporter is not greater than the discharge starting electric field of the air.

29. The electrophotographic recording apparatus as described in claim 28, wherein said forward end voltage is selected at such a value that a visible image of the photosensitive member is transferrable to the recording paper.

30. The electrophotographic recording apparatus of claim 28, wherein a length of the forward end portion of the recording paper associated with said initial charge amount, or said initial voltage applied to said recording paper transporter, is within the range of at least 0.1 mm to 10 mm from the forward end.

31. The electrophotographic recording apparatus of claim 28, wherein said recording paper transporter comprises a belt of dielectric material.

* * * * *

UNITED STATES PATENT AND TRADEMARK OFFICE

CERTIFICATE OF CORRECTION

PATENT NO. : 5,321,477

DATED : June 14, 1994

INVENTOR(S) : Tetuya NAGATA et al.

It is certified that error appears in the above-indentified patent and that said Letters Patent is hereby corrected as shown below:

| Column | Line | Corrections |
|---|---|---|
| 6 | 47 | After "of" insert --a--. |
| 8 | 50 | After "on" insert --a--. |
| 10 | 28 | Change "gap 76" to --gap 71--. |
| 14 | 10 | After "material" change "Of" to --of--. |
| 15 | 28 | Change "period-when" to --period when--. |
| 16 | 31 | Change "Coupling" to --coupling--. |
| 16 | 49 | Before "this" insert --with--. |
| 20 | 27 | After "making" insert --up--. |
| 20 | 60 | After "off" insert --by--. |
| 31 | 28 | After "winding" change "preventing" to --prevention--. |
| 32 | 22 | After "winding" change "preventing" to --prevention--. |

Signed and Sealed this

Twenty-seventh Day of December, 1994

*Attest:*

Bruce Lehman

BRUCE LEHMAN

*Attesting Officer*

*Commissioner of Patents and Trademarks*